US009187715B2

(12) United States Patent
Mukherjee et al.

(10) Patent No.: US 9,187,715 B2
(45) **Date of Patent: *Nov. 17, 2015**

(54) CLEANING COMPOSITIONS

(71) Applicant: The Procter & Gamble Company, Cincinnati, OH (US)

(72) Inventors: Koushik Mukherjee, Beijing (CN); Ming Tang, Beijing (CN); Yonas Gizaw, West Chester, OH (US); Qing Chen, Beijing (CN); Frank Hulskotter, Bad Duerkheim (DE); Darren Rees, Newcastle Upon Tyne (GB); Ouidad Benlahmar, Mannheim (DE); Volodymyr Boyko, Mannheim (DE); Aaron Figueroa, Mannheim (DE); Sophia Ebert, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 16 days.

This patent is subject to a terminal disclaimer.

(21) Appl. No.: 13/941,576

(22) Filed: Jul. 15, 2013

(65) Prior Publication Data

US 2014/0023609 A1 Jan. 23, 2014

Related U.S. Application Data

(60) Provisional application No. 61/673,294, filed on Jul. 19, 2012.

(30) Foreign Application Priority Data

Feb. 18, 2013 (WO) ..... CN2013/071628

(51) Int. Cl.
*C11D 3/00* (2006.01)
*C11D 3/37* (2006.01)

(52) U.S. Cl.
CPC ..... *C11D 3/0026* (2013.01); *C11D 3/3769* (2013.01); *C11D 3/3773* (2013.01); *C11D 3/3776* (2013.01)

(58) Field of Classification Search
CPC .. C11D 3/0026; C11D 3/3776; C11D 3/3773; C11D 3/3769; C11D 3/373; C11D 3/3742
See application file for complete search history.

(56) References Cited

U.S. PATENT DOCUMENTS

| | | | | |
|---|---|---|---|---|
| 3,299,112 | A | 1/1967 | Bailey | |
| 4,818,421 | A | 4/1989 | Boris et al. | |
| 5,574,179 | A | 11/1996 | Wahl et al. | |
| 5,612,410 | A | 3/1997 | Kondo et al. | |
| 5,807,956 | A | 9/1998 | Czech | |
| 5,980,931 | A | 11/1999 | Fowler et al. | |
| 5,981,681 | A | 11/1999 | Czech | |
| 6,121,165 | A | 9/2000 | Mackey et al. | |
| 6,207,782 | B1 | 3/2001 | Czech et al. | |
| 6,482,969 | B1 | 11/2002 | Helmrick et al. | |
| 6,607,717 | B1 | 8/2003 | Johnson et al. | |
| 6,673,890 | B1 | 1/2004 | Boeckh et al. | |
| 6,855,680 | B2 | 2/2005 | Smerznak et al. | |
| 7,041,767 | B2 | 5/2006 | Lange et al. | |
| 7,217,777 | B2 | 5/2007 | Lange et al. | |
| 7,335,630 | B2 | 2/2008 | Delplancke et al. | |
| 7,465,439 | B2 | 12/2008 | Avery et al. | |
| 7,732,050 | B2 * | 6/2010 | Nambu et al. | 428/407 |
| 2005/0048549 | A1 | 3/2005 | Cao et al. | |
| 2005/0098759 | A1 | 5/2005 | Frankenbach et al. | |
| 2007/0041929 | A1 | 2/2007 | Torgerson et al. | |
| 2007/0286837 | A1 | 12/2007 | Torgerson et al. | |
| 2009/0229057 | A1 | 9/2009 | Billiauw et al. | |

FOREIGN PATENT DOCUMENTS

| | | | |
|---|---|---|---|
| EP | 2 295 531 | A1 | 3/2011 |
| WO | WO 2004/056888 | A2 | 7/2004 |
| WO | WO 2006005358 | A1 * | 1/2006 |
| WO | WO 2007/028773 | A1 | 3/2007 |
| WO | WO 2011/107397 | A1 | 9/2011 |

OTHER PUBLICATIONS

Written Opinion of the International Searching Authority; International Application No. PCT/CN2013/071628; date of mailing Jan. 29, 2015; 8 pages.

Supplementary International Search Report; International Application No. PCT/CN2013/071628; date of mailing May 15, 2015; 5 pages.

* cited by examiner

*Primary Examiner* — Sue Liu
*Assistant Examiner* — Thor Nielsen
(74) *Attorney, Agent, or Firm* — James F. McBride; Steven W. Miller

(57) ABSTRACT

The present invention relates to cleaning composition, preferably a laundry detergent composition, comprising a foam control composition comprising a hydrophobically modified cationic polymer, as well as processes for making and method of using such compositions. The composition of the present invention provides for enhanced suds removal during the rinse cycle with minimal or nil impact on suds volume during the wash cycle.

14 Claims, 3 Drawing Sheets

CLEANING COMPOSITIONS

FIELD OF THE INVENTION

The present invention relates to cleaning compositions, in particular, it relates to laundry detergent products comprising a foam control composition comprising hydrophobically modified cationic polymers, and processes of making and methods of using same.

BACKGROUND OF THE INVENTION

Sudsing profile is important for a cleaning composition, particularly laundry detergent, where the appropriate volume and speed of suds formation, retention and dissolution in the wash and rinse cycles are considered key benchmarks of performance by the consumers. For laundry detergents, while a suds profile is important for machine washing process, it is even more important in a typical hand-washing process as the consumer would see changes in the suds level in the wash and rinse cycles. Typically, consumers, particularly hand-washing consumers, desire laundry detergent that dissolves in the wash liquor to give voluminous suds during the wash cycle to signify sufficient performance. The suds are then carried over to the rinse solution and require additional time, water and labour to thoroughly rinse from the laundered fabric.

However, reducing the suds level overall is not a viable option because when the consumer sees lower suds or nil suds during the washing cycle, it causes the consumer to believe that the laundry detergent is not as active. In addition, the current market demands are for laundry detergents with improved environmental sustainability (e.g., less water consumption) without negatively impacting cleaning performance or the perception of cleaning performance (i.e., appearance of suds on fabric or in the rinse solution). This, of course, reinforces the preference for laundry detergents having improved foam control composition for faster suds dissolution during the rinse cycle so as to reduce extra rinse cycles needed to remove the suds from the cleaned fabrics/rinse solution. Thus, there is a need for a cleaning composition having a sudsing profile where there is strong level of suds volume during the washing cycle, and yet quickly collapses in the rinsing solution for substantially reduced or nil suds for cost savings and environmental conservation purposes. This is known as the "single rinse" concept.

One solution has been to add a de-foamer product during the rinse cycles, but this option is cost prohibitive for most hand-washing consumers. Additionally, the prior art discloses laundry detergent compositions with various foam control agents in an attempt to address this problem. For example, PCT Publication No. WO2011/107397 (Unilever) discloses a laundry detergent composition comprising a delayed-release amino-silicone based antifoam agent to act in the rinsing cycle to highly reduce or eliminate suds, preferably after two rinse cycles. Here, the antifoam agent is absorbed onto a carrier filler. EP Publication No. EP0685250A1 (Dow Corning) discloses a foam control composition for use in laundry detergents that inhibits the formation of new suds during the post-wash rinsing cycles, but which does not appear to quicken the elimination of already existing suds carried over from the wash cycle.

Accordingly, there is a need for a cleaning composition, preferably a laundry detergent, which permits strong suds formation during the washing while eliminating the suds quickly during the rinse cycle(s), preferably across a range of consumer wash habits and fabric/material surfaces being washed, so that a single rinse cycle might be sufficient to remove the suds. There is also a need for a cleaning composition, preferably a laundry detergent, having substantially improved benefits, such as for example, improved rinse clarity of a laundry liquor, positive effect on skin by the consumer using the laundry detergent, or improved fabric feel after the items have been laundered using the laundry detergent.

It is desirable that the cleaning compositions are preferably relevant to an anionic detersive surfactant system, such as for example, alkyl benzene sulphonic acid or salt thereof, alkyl ethoxylated sulphate, or a mixture thereof.

SUMMARY OF THE INVENTION

The present invention relates to a cleaning composition comprising a foam control composition which exhibit improved suds removal in the rinse cycle without negatively impacting the suds level in the wash cycle when formulated in a product, preferably a laundry detergent for machine or hand-washing fabric. It has now been discovered that such challenges can be met by using a foam control composition comprising a hydrophobically modified cationic polymer, which includes covalently attached silicones. The hydrophobically modified cationic polymers of the invention have shown outstanding anti-suds benefit with no or minimal negatives on cleaning performance.

The hydrophobically modified cationic polymer of the invention is obtainable through the polymerization of structure units derived from: (i) a first structural unit derived from one or more cationic ethylenically unsaturated monomers, (ii) a second structural unit derived from an ethylenically unsaturated monomer having a functionality selected from the group consisting of an epoxy, anhydride, imide, lactone, carboxylic acid and isocyanate; (iii) a third structural unit derived from one or more water-soluble monomers; and (iv) a fourth structural unit derived from a reactive siloxane.

In one aspect, the hydrophobically modified cationic polymer is derived from the following structural units, wherein: (i) the first structural unit is diallyl dimethyl ammonium chloride, (ii) the second structural unit is glycidyl methacrylate, (iii) the third structural unit is a mixture of vinylpyrrolidone and (meth)acrylamide, and (iv) the fourth structural unit is an aminosilicone.

In another aspect, the hydrophobically modified cationic polymer comprises a first structural unit, from about 5 wt % to about 98 wt %, preferably from about 7 wt % to about 85 wt %, and more preferably from about 9 wt % to about 75 wt %; a second structural unit, from about 1 wt % to 20 wt %, preferably from about 2 wt % to about 15 wt %, and more preferably from about 4 wt % to about 12 wt %; a third structural unit, from 0 wt % to about 85 wt %, preferably from about 5 wt % to about 85 wt %, and more preferably from about 24 wt % to about 85 wt %; and a fourth structural unit, from 1 wt % to about 20 wt %, more preferably from about 4 wt % to about 18 wt %, and even more preferably from about 5 wt % to about 15 wt %. Herein, the wt % is based on 100% by weight of all structural units derived from all the monomers and the reactive siloxane present in the hydrophobically modified cationic polymer.

These and other features of the present invention will become apparent to one skilled in the art upon review of the following detailed description when taken in conjunction with the appended claims.

BRIEF DESCRIPTION OF THE DRAWINGS

While the specification concludes with claims particularly pointing out and distinctly claiming the invention, it is believed that the invention will be better understood from the following description of the accompanying figures wherein:

DETAILED DESCRIPTION OF THE INVENTION

Definitions

Figure 1:
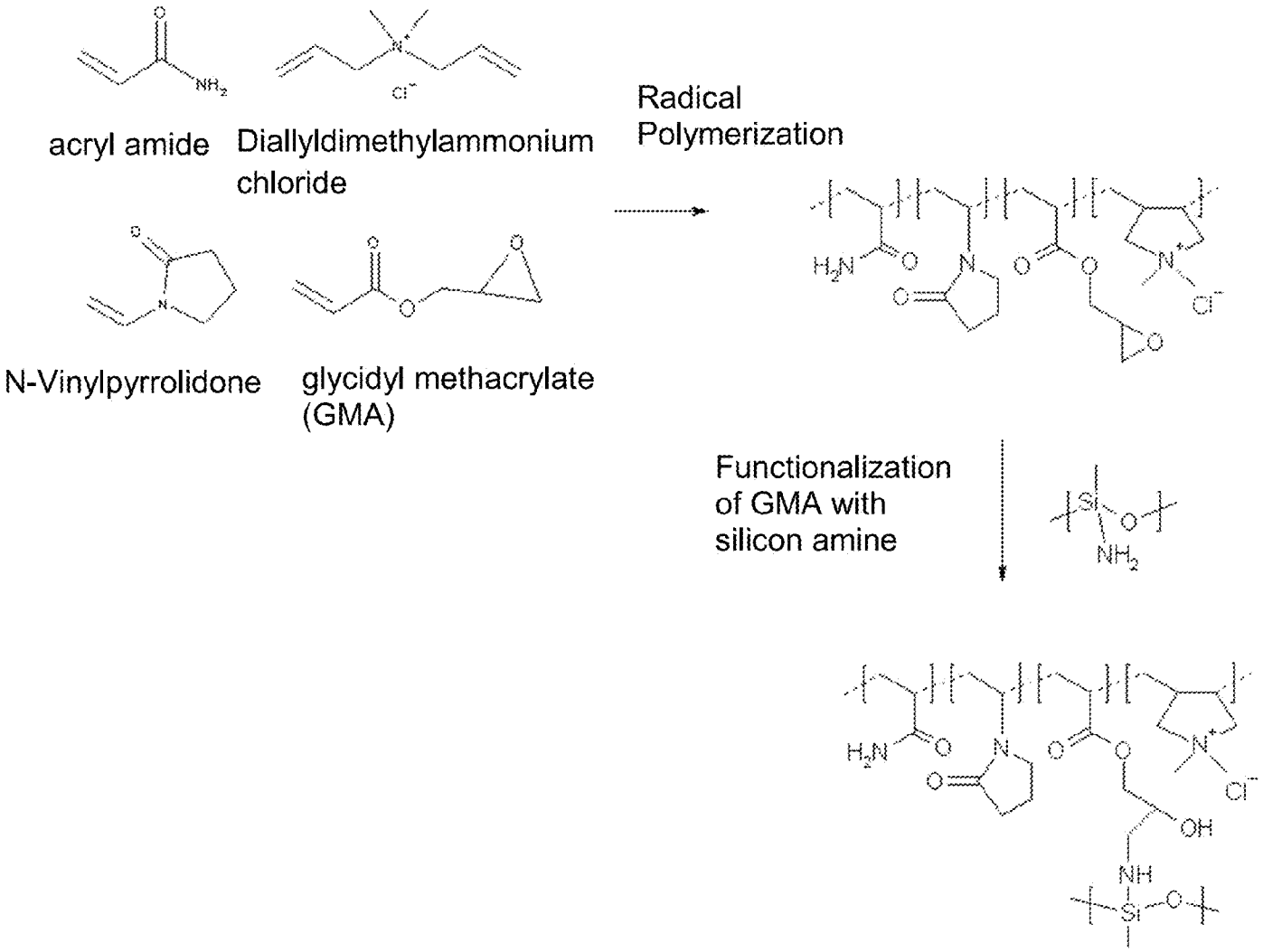
FIG. 1 provides the polymerization reaction scheme for making the hydrophobically modified cationic polymer of the present invention.

As used herein "suds" means a non-equilibrium dispersion of gas bubbles in a relatively smaller volume of a liquid. Terms like "suds", "foam" and "lather" can be used interchangeably in the present specification.

As used herein, the term "cleaning composition" means a liquid or solid composition for treating fabrics, hard surfaces and any other surfaces in the area of fabric and home care, and includes hard surface cleaning and/or treatment including floor and bathroom cleaners (e.g., toilet bowl cleaners); hand dishwashing agents or light duty dishwashing agents, especially those of the high-foaming type; machine dishwashing agents; personal care compositions; pet care compositions; automotive care compositions; and household care compositions. In one embodiment, the cleaning composition of the present invention is a hard surface cleaning composition, preferably wherein the hard surface cleaning composition impregnates a nonwoven substrate.

As used herein, the term "laundry detergent composition" is a subset of "cleaning composition", and includes a liquid or solid composition, and includes, unless otherwise indicated, granular or powder-form all-purpose or "heavy-duty" washing agents for fabric, especially cleaning detergents as well as cleaning auxiliaries such as bleach, rinse aids, additives or pre-treat types. In one embodiment, the laundry detergent composition is a solid laundry detergent composition, and preferably a free-flowing particulate laundry detergent composition (i.e., a granular detergent product).

As used herein, the term "average molecular weight" refers to the average molecular weight of the polymer chains in a polymer composition. Further, the "weight average molecular weight" ("Mw") may be calculated using the equation:

$$Mw=(\Sigma i\ Ni\ Mi^2)/(\Sigma i\ Ni\ Mi^2)$$

Where Ni is the number of molecules having a molecular weight Mi. The weight average molecular weight must be measured by the method described in the Test Methods section.

As used herein "random" means that the units of the polymer are randomly distributed throughout the polymer chain.

As used herein "blocky" means that multiple units the polymer are placed end to end throughout the polymer chain.

When a moiety or an index of a preferred embodiment is not specifically defined, such moeity or index is as previously defined.

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel, paste and gas product forms.

All temperatures herein are in degrees Celsius (° C.) unless otherwise indicated.

The recitation of numerical ranges with endpoints includes all numbers subsumed within that range (e.g., 1 to 5 includes 1, 1.5, 3.8, 4 and 5).

It is understood that the test methods that are disclosed in the Test Methods Section of the present application must be used to determine the respective values of the parameters of Applicants' inventions are described and claimed herein.

In all embodiments of the present invention, all percentages are by weight of the total composition, unless specifically stated otherwise. All ratios are weight ratios, unless specifically stated otherwise.

Compositions Comprising Foam Control Composition

Specifically, the present invention provides a cleaning composition comprising a foam control composition, wherein the foam control composition comprises a hydrophobically modified cationic polymer aforementioned. In one aspect, the cleaning composition can be hard surface cleaners, such as for example, dish washing detergents, and those used in the health and beauty areas, including shampoos and soaps, which may benefit from products having improved sudsing profiles. In another aspect, the cleaning composition is suitable for laundry detergent application, for example: laundry, including automatic washing machine laundering or hand-washing, or cleaning auxiliaries, such as for example, bleach, rinse aids, additives or pre-treat types. The laundry detergent composition is preferably a powder or granular laundry detergent and can be a fully formulated laundry detergent product.

Foam Control Composition

The foam control composition of the present invention comprises a hydrophobically modified cationic polymer obtainable from the polymerization of the following structural units:

(i) a first structural unit derived from one or more cationic ethylenically unsaturated monomers;

(ii) a second structural unit derived from an ethylenically unsaturated monomer having an epoxy, anhydride, imide, lactone, carboxylic acid or isocyanate functionality;

(iii) a third structural unit derived from one or more water-soluble monomer; and (iv) a fourth structural unit derived from a reactive siloxane.

(i) First Structural Unit

The first structural unit is a water-soluble cationic ethylenically unsaturated monomer. The first structural unit can be a dialkyl diallyl ammonium with halides, hydrogensulfate or methosulfate as counterions according to formula (I):

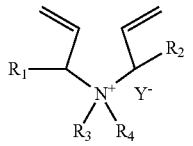

(I)

wherein:

$R_1$ and $R_2$ are, independently of one another, hydrogen or $C_1$-$C_4$ alkyl;

$R_3$ and $R_4$ are, independently of one another, hydrogen, alkyl, hydroxyalkyl, carboxyl alkyl, carboxyamide alkyl or alkoxyalkyl groups having from 1 to 18 carbon atoms; and Y— is the counterion selected from the group consisting of chloride, bromide, iodine or hydrogensulfate or methosulfate.

In another embodiment, the first structural unit is a quaternary or acid salt of dialkyl amino alkyl (meth)acrylate. In a further embodiment, the first structural unit is an acid salt of a dialkyl amino alkyl (meth) acrylamide or a quaternary dialkyl amino alkyl (meth) acrylamide according to formula (II):

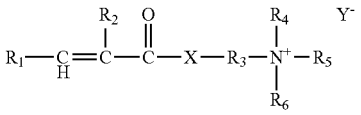

(II)

wherein:

$R_1$ is H or $C_1$-$C_4$ alkyl;

$R_2$ is H or methyl;

$R_3$ is $C_1$-$C_4$ alkylene;

$R_4$, $R_5$ and $R_6$ are each independently H or $C_1$-$C_{30}$ alkyl;

X is —O— or —NH—; and

Y is Cl; Br; I; hydrogensulfate or methosulfate.

In one embodiment of the present invention, it is preferred that, in the cationic monomer of the formula (II), wherein:

i) $R_1$ and $R_2$ are each H or ii) $R_1$ is H and $R_2$ is $CH_3$ or preferably also H.

Suitable examples of the first structural unit are diallyl dimethyl ammonium chloride (DADMAC), (3-acrylamidopropyl)-trimethylammonium chloride (APTAC), (3-methacryl-amidopropyl)-trimethylammonium chloride (MAPTAC), dimethylaminopropylacrylat methochlorid, dimethylaminopropylmethacrylat methochlorid. Further suitable examples of the first structural unit are [2-(Acryloyloxy)ethyl]trimethylammonium chloride, also referred to as dimethylaminoethyl acrylate methochloride (DMA3*MeCl), or trimethyl-[2-(2-methylprop-2-enoyloxy)ethyl]azanium chloride, also referred as dimethylaminoethyl methacrylate methochloride(DMAEMA*MeCl). Preferably, the first structural unit is DADMAC.

(ii) Second Structural Unit

The second structural unit is an ethylenically unsaturated monomer having a functionality as selected from the group consisting of an epoxy, anhydride, imide, lactone, carboxylic acid, and isocyanate. Examples of olefinically unsaturated monomers having an anhydride functional group are maleic anhydride, glutaconic anhydride and itaconic anhydride. An example of an olefinically unsaturated monomers having an imide functional group is maleimide. Examples of olefinically unsaturated carboxylic acids are acrylic acid, methacrylic acid and maleic acid. Preferably, the second structural unit is an epoxy-functional (meth)acrylic monomer of formula (III):

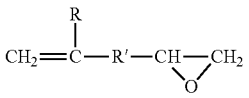

(III)

Examples of formula (III) include glycidyl acrylate, glycidyl methacrylate, 3,4-epoxybutyl acrylate, 3,4-epoxybutyl methacrylate, vinylbenzyl glycidyl ether, allyl glycidyl ether or an ethylenically unsaturated monomer having an anhydride functionality such as maleic anhydride or glutaconic anhydride. Preferred examples of formula (III), wherein R is preferably hydrogen or alkyl of 1 to about 7 carbons and R' is an hydrocarbon moiety preferably alkyl or $COO(CH_2)_n$ with n having a value of from 0 to 7. More preferably, the second structural unit is glycidyl methacrylate (GMA).

(iii) Third Structural Unit

The third structural unit is hydrophilic. Usually, the third structural unit has a solubility in water of at least 60 g/L at 20° C., preferably of at least 80 g/L and more preferably of at least 100 g/L. For example, the third structural unit may be dissolved in water at 20° C. in an amount of up to 200 g/L or more. Suitable examples of the third structural unit are N-vinylpyrrolidone, (meth)acrylamide, N-Vinyl formamide, vinyl acetate, vinyl imidazole, polyethylene glycol methyl ether methacrylate, poly (propylene glycol) methacrylate or mixtures thereof. Preferably, the third structural unit is a mixture of vinylpyrrolidone and (meth)acrylamide, (iv) Fourth Structural Unit The fourth structural unit is a reactive siloxane comprising Si—O moieties wherein said reactive siloxane is a polymer which may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one embodiment of the present invention, the reactive siloxane is a silicone aminoalcohol. In another embodiment of the present invention, the reactive siloxane is an aminosilicone. The aminosilicone may comprise the structure of formula (IV):

$$[R_1R_2R_3SiO_{1/2}]_{(j+2)}[(R_4Si(X—K)O_{2/2}]_k[R_4R_4SiO_{2/2}]_m[R_4SiO_{3/2}]_j \quad (IV)$$

wherein:

j is a number from 0 to about 98; in one aspect j is a number from 0 to about 48; in one aspect, j is 0;

k is an integer from 0 to about 200, in one aspect k is an integer from 0 to about 50; when k=0, at least one of $R_1$, $R_2$ or $R_3$ is —X—K;

m is a number from 4 to about 5,000; in one aspect m is a number from about 10 to about 4,000; in another aspect m is a number from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and —X—K; with the proviso that when k=0, at least one of $R_1$, $R_2$ or $R_3$ is —X—K; and each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

wherein each X—K, X comprises a divalent alkylene radical comprising 2-12 carbon atoms, in one aspect, each of said divalent alkylene radical is independently selected from the group consisting of —$(CH_2)_s$— wherein s is an integer from about 2 to about 8, in one aspect s is an integer from about 2 to about 4;

each K is selected independently from the group consisting of

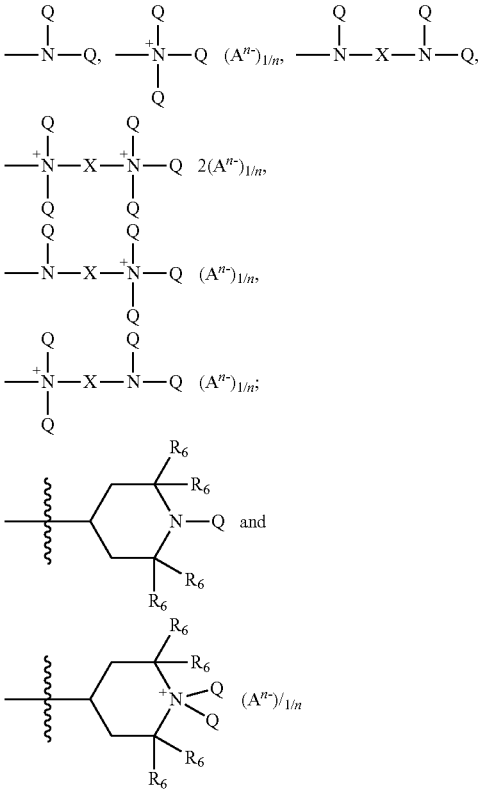

with the proviso that when K is quaternary, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H.

The aminosilicone has preferably a viscosity at 25° C. of from 50 $mm^2/s$ to 15000 $mm^2/s$, preferably, 500 $mm^2/s$ to 5000 $mm^2/s$, and even more preferably 1000 $mm^2/s$ to 2500 $mm^2/s$.

In another embodiment of the present invention, the reactive siloxane is a silicone polyether, also referred to as "dimethicone copolyol". In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in US Publication No. 2005/0098759, and U.S. Pat. Nos. 4,818,421 and 3,299,112. Preferably, the fourth structural unit is an aminosilicone according to formula (IV).

In another embodiment, suitable silicones comprise Si—O moieties and may be selected from (a) non-functionalized siloxane polymers, (b) functionalized siloxane polymers, and combinations thereof. The molecular weight of these organosilicones is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked. In one aspect, the organosilicones may comprise silicone resins. Silicone resins are highly cross-linked polymeric siloxane systems. The cross-linking is introduced through the incorporation of trifunctional and tetrafunctional silanes with monofunctional or difunctional, or both, silanes during manufacture of the silicone resin.

Silicone materials and silicone resins in particular, can conveniently be identified according to a shorthand nomenclature system known to those of ordinary skill in the art as "MDTQ" nomenclature. Under this system, the silicone is described according to presence of various siloxane monomer units which make up the silicone. Briefly, the symbol M denotes the monofunctional unit $(CH_3)_3SiO_{0.5}$; D denotes the difunctional unit $(CH_3)_2SiO$; T denotes the trifunctional unit $(CH_3)SiO_{1.5}$; and Q denotes the quadra- or tetra-functional unit $SiO_2$. Primes of the unit symbols (e.g., M', D', T', and Q') denote substituents other than methyl, and must be specifically defined for each occurrence.

In one aspect, silicone resins for use in the compositions of the present invention include, but are not limited to MQ, MT, MTQ, MDT and MDTQ resins. In one aspect, Methyl is a highly suitable silicone substituent. In another aspect, silicone resins are typically MQ resins, wherein the M:Q ratio is typically from about 0.5:1.0 to about 1.5:1.0 and the average molecular weight of the silicone resin is typically from about 1000 to about 10,000.

Other modified silicones or silicone copolymers are also useful herein. Examples of these include silicone-based quaternary ammonium compounds (Kennan quats) disclosed in U.S. Pat. Nos. 6,607,717 and 6,482,969; end-terminal quaternary siloxanes; silicone aminopolyalkyleneoxide block copolymers disclosed in U.S. Pat. Nos. 5,807,956 and 5,981,681; hydrophilic silicone emulsions disclosed in U.S. Pat. No. 6,207,782; and polymers made up of one or more crosslinked rake or comb silicone copolymer segments disclosed in U.S. Pat. No. 7,465,439. Additional modified silicones or silicone copolymers useful herein are described in US Publication Nos. 2007/0286837A1 and 2005/0048549A1.

In alternative embodiments of the present invention, the above-noted silicone-based quaternary ammonium compounds may be combined with the silicone polymers described in U.S. Pat. Nos. 7,041,767 and 7,217,777 and US Publication No. 2007/0041929A1.

In one aspect, the organosilicone may comprise a non-functionalized siloxane polymer that may have formula (V) below, and may comprise polyalkyl and/or phenyl silicone fluids, resins and/or gums:

$$[R_1R_2R_3SiO_{1/2}]_n[R_4R_4SiO_{2/2}]_m[R_4SiO_{3/2}]_j \quad (V)$$

wherein:

(i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

(ii) n may be an integer from about 2 to about 10, or from about 2 to about 6; or 2; such that n=j+2;

(iii) m may be an integer from about 5 to about 8,000, from about 7 to about 8,000 or from about 15 to about 4,000; and (iv) j may be an integer from 0 to about 10, or from 0 to about 4, or 0.

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature $SiO_{4-n/2}$ represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the names DC 200 Fluid, DC 1664, DC 349, DC 346G available from Dow Corning® Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

Other suitable examples of organosilicone (fourth structural unit) are listed in Table 1.

In a preferred embodiment, the hydrophobically modified cationic polymer of the invention is obtainable by the polymerization of:

(i) the first structural unit from about 5 wt % to about 98 wt %, preferably from about 7 wt % to about 85 wt %, and more preferably from about 9 wt % to about 75 wt %;

(ii) the second structural unit from about 1 wt % to 20 wt %, preferably from about 2 wt % to about 15 wt %, and more preferably from about 4 wt % to about 12 wt %;

(iii) the third structural unit from about 0 wt % to about 85 wt %, preferably from about 5 wt % to about 85 wt %, and more preferably from about 24 wt % to about 85 wt %; and (iv) the fourth structural unit from 1 wt % to about 20 wt %, preferably from about 4 wt % to about 18 wt %, and more preferably from about 5 wt % to about 15 wt %.

All wt % for each of the structural units are calculated based on 100% by weight of all structural units derived from all the monomers and the reactive siloxane present in the hydrophobically modified cationic polymer.

Process of Making Hydrophobically Modified Cationic Polymer

The process for preparing the hydrophobically modified cationic polymer according to the invention comprises the following steps:

(i) free-radical polymerization of the first, second and third structural units; and

TABLE 1

Examples of Siloxanes

| Silicone N | — | Silicone class | Technical information | Structure |
|---|---|---|---|---|
| X1 | — | amino silicone | Viscosity 25° C. = 1300 $mm^2/s$<br>Functional group equivalent weight [g/mol] = 1700 | 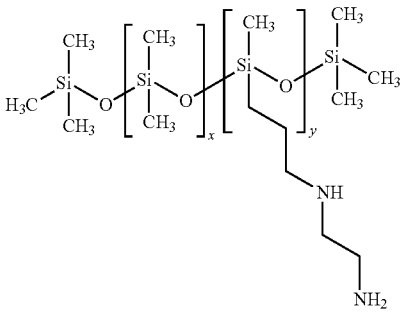 |
| X2 | — | | Viscosity 25° C. = 1500 $mm^2/s$<br>Functional group equivalent weight [g/mol] = 3800<br>Mw = 30000 g/mol | |
| X3 | — | | Mw = 45000 g/mol<br>Functional group equivalent weight [g/mol] = 4300<br>X = approximately 500<br>Y = approximately 4 | |
| X4 | — | | X = approximately 444<br>Y = approximately 9 | |
| X5 | PDMS | polydimethyl siloxane | viscosity = 5000 cst | 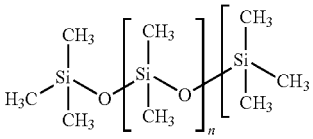 |
| X6 | — | Silicone polyether | hydroproxylated amino silicone X3 | 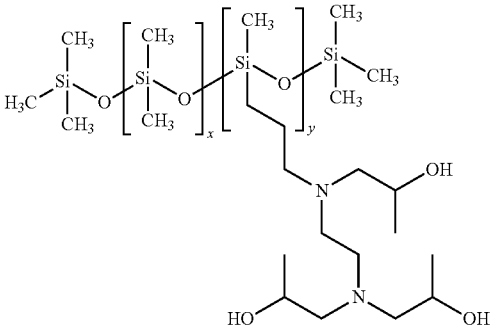 |
| X7 | — | | X7 = ½ Mw of X6<br>Viscosity = 2,600-2,850 cps | |
| X8 | — | | partially hydroproxylated silicone targeting 50% substitution, NMR showing susbtitution to be 50% to 67% of X1 | |

(ii) subsequent polymer-analogic reaction of the epoxy, anhydride, imide, lactone, carboxylic acid or isocyanate functionality of the polymer by the fourth structural unit.

Step (i)

The polymerization of step (i) is a free-radical polymerization and is preferably carried out in solution, for example in water or in a polar organic solvent such as one or more alcohol, ketone or ester solvents selected from butanol, t-butanol, isopropanol, butoxyethanol, methyl isobutyl ketone, methyl ethyl ketone, butyl acetate or ethyl actetate and/or an aromatic hydrocarbon such as xylene, toluene or trimethylbenzene a blend of one or more of these. The solvent used for the solution polymerization is preferably water.

The solution polymerization preferably takes place at a temperature in the range from 50° C. to 140° C., preferably from 60° C. to 100° C., in particular from 70° C. to 95° C. The polymerization is usually carried out under atmospheric pressure, although it can also proceed under reduced or elevated pressure. A suitable pressure range is between 1 and 5 bar. The polymerization is carried out during a time of 2 h and 5 h, preferably 2 h and 4 h.

The first, second and third structural units can be polymerized with the help of initiators which form free radicals, in the amounts customarily used, preferably from 0.1% to 5% by weight, and more preferably from 0.5% to 1% by weight, based on the total mass of the monomers to be polymerized.

Initiators for the free-radical polymerization which can be used are the peroxo and/or azo compounds customary for this purpose, for example alkali metal or ammonium peroxydisulfates, sodium persulfate, diacetyl peroxide, dibenzoyl peroxide, succinyl peroxide, di-tert-butyl peroxide, tert-butyl perbenzoate, tert-butyl perpivalate, tert-butyl peroxy-2-ethylhexanoate, tert-butyl permaleate, cumene hydroperoxide, diisopropyl peroxydicarbamate, bis(o-toloyl) peroxide, didecanoyl peroxide, dioctanoyl peroxide, dilauroyl peroxide, tert-butyl perisobutyrate, tert-butyl peracetate, di-tert-amyl peroxide, tert-butyl hydroperoxide, 2,2'-azobisisobutyronitrile, azobis(2-amidinopropane) dihydrochloride or 2-2'-azobis(2-methylbutyronitrile). Also suitable are initiator mixtures or redox initiator systems, such as, for example, ascorbic acid/iron(II) sulfate/sodium peroxodisulfate, tert-butyl hydroperoxide/sodium disulfite, tert-butyl hydroperoxide/sodium hydroxymethanesulfinate, $H_2O_2/Cu^I$.

The polymerization can be carried out continuously, semi-continuously or batch-wise. A plurality of monomers may be added separately or as mixtures, which can be produced, for example, by preparing a premix in a stirred vessel or by combining the individual feeds in a common pipeline. The initiator is usually added via a separate feed, but the monomer feed and initiator feed may be combined before entering the reaction vessel. Depending on the compatibility, the other components of the reaction mixture, e.g., polymerization regulators, are added together with one of the abovementioned feeds or separately, either in pure form or in a suitable solvent. In a suitable embodiment the polymerization can be carried out semi-continuously. According to this embodiment, at least one monomer can be initially introduced into a reactor and heated to the polymerization temperature, the monomer(s) and the free radical initiator being added either in one or more than one batches or preferably continuously to the reactor, and then be polymerized.

Where appropriate, after the main polymerization has taken place, a post-polymerization is performed to further polymerize the residual unreacted first, second and third structural units. In general, post-polymerization (i.e., chemical deodorization) denotes a process for removing at least a part of the residual monomers from a polymer composition by treating said composition under polymerization conditions with an initiator. In the post-polymerization, an initiator different from, similar to or the same as the initiator of the main polymerization is employed, for example a redox-initiator system. For the post-polymerization, the initiator is generally used in an amount from 0.01% to 1% by weight, in particular from 0.05% to 0.3% by weight, based on the total weight of the monomers initially employed.

The temperature at which the post-polymerization of step (ii) is carried out is within the range of from 10° C. to 200° C., in particular from 20° C. to 100° C. The post-polymerization generally takes place for a period of from about 1 h to about 6 h, more preferably from about 2 h to about 4 h. The initiator system can be added continuously or in portions essentially throughout the period of post-polymerization. Nevertheless, it is also possible to add a single dosage at the beginning of the post-polymerization. The adding of the initiator system depends inter alia on the temperature and the dissolution kinetics.

The post-polymerization may be performed under reduced pressure, at ambient pressure or at elevated pressure.

Step (ii)

The polymeric product obtained from step (i) has a functional group capable of reacting via ring opening or other condensation processes with the amino groups of the reactive siloxane. The functional group capable of reacting with the amino groups of the reactive siloxane can alternatively be an anhydride, imide, lactone, carboxylic acid or isocyanate.

Anhydride groups react with amino groups to form an amide linkage. Imide groups react with amino groups to form an amide linkage. Lactones react with amino groups to form an amidic ester linkage. Carboxylic acid groups react with amino groups, which can be tertiary, secondary or primary amino groups, at temperatures below about 100° C. to form an ionic salt linkage, and at temperatures above about 100° C. react with primary or secondary amine groups to form an amide linkage.

The reaction between the amino-functional polysiloxane (fourth structural unit) and the addition polymer is preferably carried out in solution, for example in a polar organic solvent as described for step (i) or in water. The reaction can conveniently be carried out by adding the amino-functional polysiloxane (fourth structural unit) to the polymer solution obtained in step (i). The reagents are usually heated to effect reaction. The preferred temperature of reaction depends on the nature of the functional group in monomer (second structural unit) which reacts with the amino groups of polysiloxane (fourth structural unit). When the functional group is an epoxide group, for example when monomer (second structural unit) is glycidyl methacrylate, the preferred temperature of reaction is generally in the range 60° C. to 120° C.

In another embodiment of the invention, the polymer solution obtained after step (i) may be cooled down and the reaction of step (ii) may take place at room temperature, i.e., at around 20° C. to 25° C. The amino-functional polysiloxane (fourth structural unit) and the polymer resulting from step (i) can be reacted in various proportions. For example the amino groups of (fourth structural unit) may be present in stoichiometric excess over the functional groups derived from monomer (second structural unit), forming a polymeric product having residual unreacted amino groups. Such a polymeric product may be preferred for greater substantivity to fibrous substrates or softness of handle of the treated material. Alternatively the polysiloxane and the addition copolymer can be reacted in approximately stoichiometric amounts of amino groups of (fourth structural unit) and functional groups derived from monomer (second structural unit), or the functional groups derived from monomer (second structural unit) may be present in stoichiometric excess over the amino groups of (fourth structural unit), forming a polymeric product bearing substantially no residual unreacted amino groups. Such a polymeric product may be preferred for maximum hydrophobicity. A representation of the reaction process of the inventive hydrophobically modified cationic polymer is depicted in FIG. 1.

POLYMER EXAMPLES

Example P1

In a 4 L stirred vessel, water (1148.8 g), diethylentriaminepentaacetic acid, pentasodium (0.99 g), glycidylmethacrylate (5.19 g), vinylpyrrolidone (5.63 g), acrylamide in water (50%, 50.28 g), and diallyldimethylammonium chloride in water (65%, 96.86 g) were charged and heated to 80° C. under a flow of nitrogen. A solution of sodium persulfate (2.47 g) in water (98.9 g) is added over 4 h. Once the persulfate solution has been fed for 15 min, a solution of glycidylmethacrylate (34.78 g), vinylpyrrolidone (22.52 g), acrylamide in water (50%, 201.14 g), diallyldimethylammonium chloride in water (65%, 387.42 g) and water (357.37 g) are added together in one feed over 2 h and 45 min. The polymerization mixture is kept at this temperature for an additional 1 h after both streams have finished. Subsequently a solution of sodium persulfate (2.47 g) in water (98.83 g) is added over 1 h, the reaction kept at this temperature for 2 h and then left to cool down to room temperature. To the tetrapolymer solution, the silicon polymer amino silicone represented by X4 (24.96 g) is added, stirred vigorously while heating to 80° C., and kept at this temperature for 1 h. The mixture is then cooled down to room temperature and filtered over an ED-Schnellsieb® 400 μm to yield the silicon functionalized product.

Example P2

In a 4 L stirred vessel, water (1128.92 g), diethylentriaminepentaacetic acid, pentasodium (0.99 g), glycidylmethacrylate (7.97 g), acrylamide in water (50%, 127.45 g), and diallyldimethylammonium chloride in water (65%, 41.81 g) were charged and heated to 80° C. under a flow of nitrogen. A solution of sodium persulfate (2.47 g) in water (98.8 g) is added over 4 h. Once the persulfate solution has been fed for 15 min, a solution of glycidylmethacrylate (31.86 g), acrylamide in water (50%, 509.82 g), diallyldimethylammonium chloride in water (65%, 167.25 g) and water (279.78 g) are added together in one feed over 2 h and 45 min. The polymerization mixture is kept at this temperature for an additional 1 h after both streams have finished. Subsequently a solution of sodium persulfate (2.47 g) in water (98.83 g) is added over 1 h, the reaction kept at this temperature for 2 h and then left to cool down to room temperature. To the terpolymer solution the silicon polymer represented by X4 (24.96 g) is added, stirred vigorously while heating to 80° C. and kept at this temperature for 1 h. The mixture is then cooled down to room temperature and filtered over an ED-Schnellsieb® 400 μm to yield the silicon functionalized product.

Example P3

In a 4 L stirred vessel, water (1,152.77 g), diethylentriaminepentaacetic acid, pentasodium (0.99 g), glycidylmethacrylate (4.12 g), acrylamide in water (50%, 15.05 g), and diallyldimethylammonium chloride in water (65%, 134.19 g) were charged and heated to 80° C. under a flow of nitrogen. A solution of sodium persulfate (2.47 g) in water (98.8 g) is added over 4 h. Once the persulfate solution has been fed for 15 min, a solution of glycidylmethacrylate (16.49 g), acrylamide in water (50%, 60.21 g), diallyldimethylammonium chloride in water (65%, 536.75 g) and water (375.28 g) are added together in one feed over 2 h and 45 min. The polymerization mixture is kept at this temperature for an additional 1 h after both streams have finished. Subsequently a solution of sodium persulfate (2.47 g) in water (98.83 g) is added over 1 h, the reaction kept at this temperature for 2 h and then left to cool down to room temperature. To the terpolymer solution the silicon polymer represented by X4 (24.96 g) is added, stirred vigorously while heating to 80° C. and kept at this temperature for 1 h. The mixture is then cooled down to room temperature and filtered over an ED-Schnellsieb® 400 μm to yield the silicon functionalized product.

Example P4

In a 2 L stirred vessel, water (557.7 g), diethylentriaminepentaacetic acid, pentasodium (0.48 g), glycidylmethacrylate (5.74 g), acrylamide in water (50%, 25.81 g), and diallyldimethylammonium chloride in water (65%, 45.16 g) were charged and heated to 80° C. under a flow of nitrogen. A solution of sodium persulfate (1.20 g) in water (48.0 g) is added over 4 h. Once the persulfate solution has been fed for 15 min, a solution of glycidylmethacrylate (22.94 g), acrylamide in water (50%, 103.26 g), diallyldimethylammonium chloride in water (65%, 180.66 g) and water (172.8 g) are added together in one feed over 2 h and 45 min. The polymerization mixture is kept at this temperature for an additional 1 h after both streams have finished. Subsequently a solution of sodium persulfate (1.20 g) in water (48.00 g) is added at once, the reaction kept at this temperature for 2 h and then left to cool down to room temperature. To the terpolymer solution the silicon polymer represented by X4 (24.96 g), in this case the polymer was split in three and only 7.8 g silicon is added is added, stirred vigorously while heating to 80° C. and kept at this temperature for 1 h. The mixture is then cooled down to room temperature and filtered over an ED-Schnellsieb® 400 μm to yield the silicon functionalized product.

Example P5

In a 2 L stirred vessel, water (998.02 g), diethylentriaminepentaacetic acid, pentasodium (0.64 g) and glycidylmethacrylate (1.78 g), were charged and heated to 80° C. under a flow of nitrogen. A solution of sodium persulfate (1.58 g) in water (63.17 g) is added over 6 h. Once the persulfate solution has been fed for 15 min, glycidylmethacrylate (7.12 g), and diallyldimethylammonium chloride in water (65%, 443.71 g) are added in two independent feeds over 2 h and 45 min. The polymerization mixture is kept at this temperature for an additional 1 h after both streams have finished. Subsequently a solution of sodium persulfate (1.58 g) in water (63.17 g) is added at once, the reaction kept at this temperature for 2 h and then left to cool down to room temperature. To the copolymer solution the silicon polymer represented by X4 (24.96 g) is added, stirred vigorously while heating to 80° C. and kept at this temperature for 1 h. The mixture is then cooled down to room temperature and filtered over an ED-Schnellsieb® 400 μm to yield the silicon functionalized product.

Further Polymerization Examples

Polymers P6 to P8 and P12 were prepared in a similar way as described in Example P1, taking the monomers, the type of amino-silicone and the respective amounts given in Table 2.

Polymers P9 to P11 were prepared in a similar way as described in Example P2, taking the monomers, the type of amino-silicone and the respective amounts given in Table 2. Polymers P13-a to P13-d were prepared in a similar way as described in Example P3, taking the monomers, the type of amino-silicone and the respective amounts given in Table 2. Polymers P14 to P17 were prepared in a similar way as described in Example P1, taking the monomers, the type of amino-silicone and the respective amounts given in Table 2.

TABLE 2

Examples of Inventive Hydrophobically Modified Cationic Polymers

| | Structural Units wt % in Functionalized Polymer | | | | | | | |
|---|---|---|---|---|---|---|---|---|
| | First Structural Unit (wt %) | Second Structural Unit (wt %) | Third Structural Unit (wt %) | | Fourth Structural Unit (wt %) | | GPC | |
| EX. | DADMAC | GMA | AAm | VP | Silicone | Silicone type | Mn (g/mol) | Mw (g/mol) |
| P1 | 60.5 | 5.0 | 24.1 | 5.4 | 5.0 | X4 | 43.600 | 194,000 |
| P2-a | 26.0 | 7.7 | 61.3 | 0.0 | 5.0 | X4 | 80.800 | 496,000 |
| P2-b | 25.5 | 7.4 | 59.7 | 0.0 | 7.4 | X7 | 76.100 | 424,000 |
| P2-c | 25.5 | 7.4 | 59.7 | 0.0 | 7.4 | X8 | 75.700 | 418,000 |
| P3 | 84.7 | 4.0 | 7.3 | 0.0 | 4.0 | X4 | 33.300 | 95,300 |
| P4 | 55.0 | 10.8 | 24.2 | 0.0 | 10.0 | X4 | 41.300 | 246,000 |
| P5 | 82.0 | 8.0 | 0.0 | 0.0 | 10.0 | X4 | 26.400 | 132,000 |
| P6 | 9.1 | 4.7 | 63.4 | 18.1 | 4.7 | X4 | — | 223,000 |
| P7 | 18.8 | 6.3 | 63.1 | 6.8 | 5.0 | X4 | 73.100 | 452,000 |
| P8 | 51.6 | 4.9 | 30.9 | 7.8 | 4.9 | X4 | 50.600 | 245,000 |
| P9 | 55.5 | 4.8 | 35.0 | 0.0 | 4.8 | X4 | 41.200 | 205,000 |
| P10-a | 75.8 | 8.9 | 6.5 | 0.0 | 8.9 | X4 | 28.200 | 143,000 |
| P10-b | 75.8 | 8.9 | 6.5 | 0.0 | 8.9 | X7 | 28.500 | 142,000 |
| P10-c | 75.8 | 8.9 | 6.5 | 0.0 | 8.9 | X8 | 28.500 | 142,000 |
| P11 | 21.8 | 13.5 | 51.2 | 0.0 | 13.5 | X4 | — | — |
| P12 | 9.2 | 4.7 | 63.0 | 18.4 | 4.7 | X4 | — | — |
| P13-a | 90.6 | 1.0 | 7.4 | 0.0 | 1.0 | X1 | — | — |
| P13-b | 90.6 | 1.0 | 7.4 | 0.0 | 1.0 | X2 | 28.400 | 68,500 |
| P13-c | 90.6 | 1.0 | 7.4 | 0.0 | 1.0 | X4 | — | — |
| P13-d | 90.6 | 1.0 | 7.4 | 0.0 | 1.0 | X3 | — | — |
| P14 | 55.0 | 10.8 | 24.2 | 0.0 | 10.0 | X8 | — | — |
| P15 | 26.1 | 7.7 | 62.2 | 0.0 | 5.0 | X8 | 75.700 | 148,000 |
| P16 | 9.0 | 4.7 | 63.3 | 18.0 | 5.0 | X4 | 90.700 | 464,000 |
| P17 | 74.8 | 8.8 | 6.5 | 0.0 | 10 | X8 | 28.500 | 142,000 |

Figure 2:
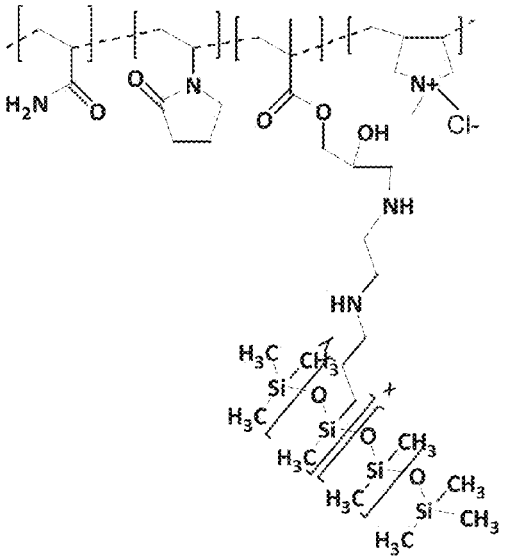
FIG. 2 provides the chemical structure for an embodiment of the hydrophobically modified cationic polymer of the present invention.

The structural units of the polymers may be arranged in either block or random fashion. FIG. 2 depicts an example of the chemical structure of a polymer of the present invention. The content of the hydrophobically modified cationic polymer in the laundry detergent is not particularly limited, but may further comprise one or more components other than the polymer. Examples of other components include, but are not particularly limited to, residual polymerization initiator, residual monomers, by-products of the polymerization, and water.

Laundry Detergents Comprising the Polymer

The laundry detergent composition of the present invention comprises a foam control composition comprising a hydrophobically modified cationic polymer. In one aspect, the hydrophobically modified cationic polymer comprises the structural units at the specified levels as described in Table 2 above. In another aspect, the hydrophobically modified cationic polymer is selected from polymers P2-a, P4, P5, P7, P14, P15, P16, and P17, preferably polymer P16.

In yet another aspect, while the level of the polymer in the laundry detergent or cleaning composition is not particularly limited, in terms of improvement in removal of suds volume during rinse cycle, the level of the hydrophobically modified cationic polymer is preferably from about 0.01 wt % to about 15 wt %, from about 0.05 wt % to about 12 wt %, from about 0.1 wt % to about 10 wt %, and from 0.4 wt % to about 5 wt % of a hydrophobically modified cationic polymer.

In yet another aspect, the hydrophobically modified cationic polymer has a weight average molecular weight (Mw) in the range of from about 90,000 g/mol to about 700,000 g/mol, preferably from about 150,000 g/mol to about 550,000 g/mol, and even more preferably from about 200,000 g/mol to about 500,000 g/mol.

In yet another aspect, the hydrophobically modified cationic polymer is substantially free of carrier particles or coating. This is advantageous as it avoids an extra step and cost associated with the incorporation of these materials.

In yet another aspect, the laundry detergent composition, optionally, comprises from about 0.1 wt % to about 50 wt %, of a surfactant selected from the group consisting of an anionic surfactant, an amphoteric surfactant, and combinations thereof. The surfactant is preferably an anionic detersive surfactant. Suitable anionic detersive surfactants include sulphate and sulphonate detersive surfactants. Preferred sulphonate detersive surfactants include alkyl benzene sulphonate, preferably $C_{10-13}$ alkyl benzene sulphonate. Suitable alkyl benzene sulphonate (LAS) is obtainable, preferably obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable.

Preferred sulphate detersive surfactants include alkyl sulphate, preferably $C_{8-18}$ alkyl sulphate, or predominantly $C_{1-2}$ alkyl sulphate. Another preferred sulphate detersive surfactant is alkyl alkoxylated sulphate, preferably alkyl ethoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 7, more preferably from 0.5 to 5 and most preferably from 0.5 to 3. The alkyl sulphate, alkyl alkoxylated sulphate and alkyl benzene sulphonates may be linear or branched, substituted or un-substituted.

In yet another aspect, the laundry detergent can be in any form, namely, in the form of a liquid; a solid such as a powder, granules, agglomerate, paste, tablet, pouches, bar, gel; an emulsion; types delivered in dual- or multi-compartment containers or pouches; a spray or foam detergent; premoistened wipes (i.e., the cleaning composition in combination with a nonwoven material such as that discussed in U.S. Pat. No. 6,121,165); dry wipes (i.e., the cleaning composition in combination with a nonwoven materials, such as that discussed in U.S. Pat. No. 5,980,931) activated with water by a consumer; and other homogeneous or multiphase consumer cleaning product forms.

In one aspect two or more of the previous aspects of the composition may be combined to form a separate aspect of the present invention.

Additional Laundry Detergent Ingredients

The balance of the laundry detergent typically contains from about 5 wt % to about 70 wt %, or about 10 wt % to about 60 wt % adjunct ingredients. Suitable detergent ingredients include: transition metal catalysts; imine bleach boosters; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6 R and 2.0 R sodium silicate, or sodium metasilicate; co-polyesters of dicarboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof. Other surfactants useful herein include cationic surfactants, nonionic surfactants, and amphoteric surfactants. Such surfactants are well known for use in laundry detergents and are typically present at levels of from about 0.2 wt % or 1 wt % to about 40 wt % or 50 wt %.

It may also be especially preferred for the laundry detergent powder to comprise low levels, or even be essentially free, of builder. The term "essentially free" means that the composition "comprises no deliberately added" amount of that ingredient. In a preferred embodiment, the laundry detergent comprises no builder.

Methods of Using the Laundry Detergent Composition

The present invention is directed to a method of cleaning fabric, the method comprising the steps of:

(i) providing a laundry detergent as described above;
(ii) forming a laundry liquor by diluting the laundry detergent with water;
(iii) washing fabric in the laundry liquor; and
(iv) rinsing the fabric in water, wherein after 2 or less rinses, preferably after 1 rinse:
  a) the laundry liquor is substantially free of suds; or
  b) at least 75%, preferably at least 85%, more preferably 95%, and even more preferably at least 99% of a surface area of the laundry liquor is free from suds.

The present invention is also directed to a method of saving water during laundering, the method comprising the steps of:

(i) providing a laundry detergent as described above;
(ii) diluting the cleaning composition with wash water in a container to form a laundry liquor;
(iii) washing laundry in the laundry liquor; and
(iv) rinsing the laundry, wherein after 2 or less rinses, preferably after 1 rinse, the laundry liquor is substantially free of suds.

The method of laundering fabric may be carried out in a top-loading or front-loading automatic washing machine, or can be used in a hand-wash laundry application.

The inventors learned unexpectedly that the laundry detergent composition comprising the hydrophobically modified cationic polymers result in enhanced removal of suds in the rinse without substantially impacting the suds volume during the wash cycle. Further, the inventors discovered that laundry detergent comprising the hydrophobically modified cationic polymers showed improve rinse clarity of the laundry liquor, preferably after fewer rinse cycles, especially after 1 rinse cycle, as compared to a similar laundry detergent without the foam control composition.

Figure 3:
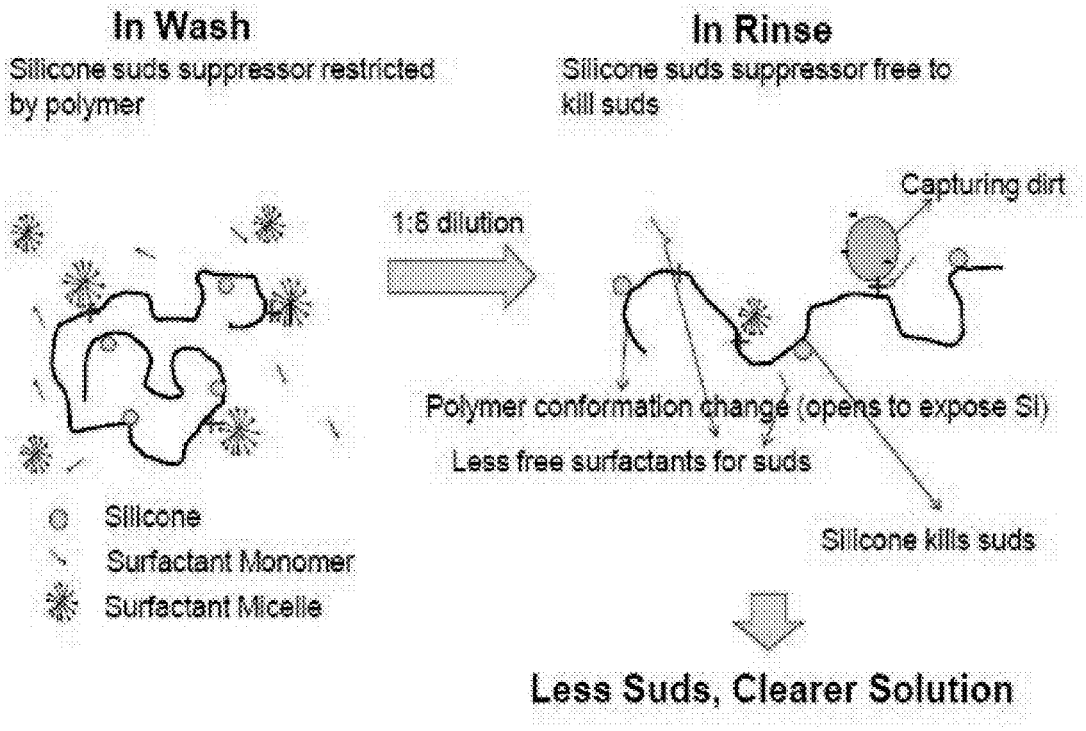
FIG. 3 provides a diagram depicting an embodiment of the conformation changes of the hydrophobically modified cationic polymer of the present invention between the wash and rinse cycles.

Without wishing to be bound by theory, it is expected that the hydrophobically modified cationic polymer adopts different conformation during the wash and rinse cycle which allows it to mediates its effects on the suds levels. FIG. 3 provides a visual depiction of the polymer's conformation during the wash and rinse cycles. It is believe that during the wash cycle, the polymer adopts a conformation whereby the covalently attached silicone, which functions as the suds suppressor, is shielded from the wash liquor. It is believed that the shielded confirmation of the polymer is due to the higher concentration of surfactants, particularly anionic detersive surfactants, which binds to the cationic portion of the polymer. During rinse, due to the higher dilution (~8× dilution) of surfactants to polymers, there is less surfactants present to bind the polymers. The polymers' conformation change to expose the silicones. The silicones migrate to the water surface due to their hydrophobic nature and penetrate the lamella of the suds thereby weakening and rupturing them. Further, the cationic part of the polymers may also capture dirt by interacting with negatively charged soils (e.g., clay), and remove them from the solution to provide better rinse clarity.

Another benefit that the inventors discovered is that of improved fabric feel, preferably improved fabric softness or improved fabric smoothness through the use of the laundry detergent composition comprising the hydrophobically modified cationic polymer. It has now been discovered that such challenges can be met by using cationic polymers hydrophobically modified with silicones. The hydrophobically modified cationic polymers of the invention have shown outstanding deposition performance without negatives. While not being bound by theory, it is believed that the polymers behave at the same time like a polymeric dispersant which leads to the stabilization of hydrophobic material like silicone in aqueous media by adsorption on the interface of the hydrophobic material but also contributes to an improved deposition of the hydrophobic material onto the fabric. The fabric thus treated shows an improved smooth feeling and better fabric softness feel.

Yet another benefit that the inventors have found is that laundry detergent composition comprising the hydrophobically modified cationic polymer leads to positive effect on the skin of users of the product. Preferably, the benefits include improved hand mildness, improved hand softness or improved hand feel. Without wishing to be bound by theory, it is believe that hand mildness comes from a synergistic combination of the silicone (which provides the soft hand feel) and coacervation arising from the cationic polymer-surfactant interactions that occur during the rinsing step, separating it from the bulk solution and depositing on the skin.

Test Methods

Various techniques are known in the art to determine the properties of the compositions of the present invention comprising the hydrophobically modified cationic polymer, however, the following assays must be used in order that the invention described and claimed herein may be fully understood.

Test 1: Measurement of Weight Average Molecular Weight (Mw)

The weight average molecular weight of the polymers are determined by the technique of Gel Permeation Chromatography (GPC) under the following conditions.

| | |
|---|---|
| Measuring device: | L-7000 series (Hitachi Ltd.) |
| Detector: | Hitachi RI Detector, L-7490 |
| Column: | SHODEX Asahipak GF-310-HQ, GF-710-HQ, GF-1G 7B (Showa Denko K. K.) |
| Column temperature: | 40° C. |
| 5 Flow velocity: | 0.5 mL/min |
| Calibration curve: | Polyacrylic Standard (Sowa Kagaku Co., Ltd.) |
| Eluent: | 0.1N sodium acetate/acetonitrile = 3/1 (mass ratio) |

Test 2: Qualification of the Monomers by HPLC

Each of the monomers of the hydrophobically modified cationic polymer are quantified by high pressure liquid chromatography (HPLC) under the following conditions.

| | |
|---|---|
| Measuring device: | L-7000 series (Hitachi Ltd.) |
| Detector: | UV detector, L-7400 (Hitachi Ltd.) |
| Column: | SHODEX RSpak DE-413 (product of Showa Denko K. K.) |
| Temperature: | 40° C. |
| Eluent: | 0.1% phosphoric acid aqueous solution |
| Flow Velocity: | 1.0 mL/min |

Test 3: Performance Evaluation (Sudsing Profile Test)

The sudsing profile of the detergent composition herein are measured by employing a suds cylinder tester (SCT). The SCT has a set of 8 cylinders. Each cylinder is typically 30 cm long and 9 cm in diameter and may be independently rotated at a rate of 20-22 revolutions per minute (rpm). This method is used to assay the performance of laundry detergent to obtain a reading on ability to generate suds as well as its suds stability and rinse suds performance. The following factors affect results and therefore should be controlled properly: (a) concentration of detergent in solution, (b) water hardness, (c) water temperature of water, (d) speed and number of revolutions, (e) soil load in the solution, and (f) cleanliness of the inner part of the tubes.

The performance is determined by comparing the suds volume generated during the washing stage by the laundry detergent containing the foam control composition versus a laundry detergent without the foam control composition (i.e., control). The amount of suds present for the detergent alone and the detergent with the foam control composition is measured by recording the total suds height (i.e., height of suds plus wash liquor) minus the height of the wash liquor alone.

1. Weigh the required amount of product and dissolve in 0.3 liters of DI water (RT) in desired hardness for at least 5 min. Dissolve the samples simultaneously.
2. Pour the sample aliquot to the tubes. Put in the rubber stopper and lock the tubes in place.
3. Spin for 10 revolutions. Lock in an upright position. Wait 1 min and check the suds height very quickly (~10 sec) left to right. Record the total suds height (i.e., height of the suds plus wash liquor) and the height of the wash liquor alone. This marks the after 10 revolutions data.
4. Spin for additional 20 revolutions. This marks the after 30 revolutions data. Take recordings from left to right.
5. Spin for 20 revolutions more. This marks the after 50 revolutions data. Take readings from left to right. Repeat this step one more time; thus, the data gathered are for after 70 revolutions.
6. Open the tubes. Add 1 piece of clay and ¼ piece of DCO into each tube. Put in the rubber stopper. Spin for 20 revolutions. This marks the after 90 revolutions data. Take readings. Repeat this step one time; thus, the data gathered are for after 110 revolutions. (Note: The addition of the artificial soil is intended to mimic the real world washing conditions where more soils dissolve into the wash liquor from the fabrics being wash. Therefore, this test is relevant for determining the initial sudsing profile of a composition and its sudsing profile in a washing cycle.)
7. Pour 150 mL solution out of the tube gently into 300 mL beaker. Add 150 mL hard water into the beaker. Adjust the solution pH to 8.5. Dispose of the remaining 150 mL solution and wash the tube with tap water. Pour the 300 mL solution into the same tube, and adjust the pH to 8.5.

8. Spin for 20 revolutions. This marks the after 130 revolutions data. Take readings from left to right. Repeat this step one time; thus data gathered are for after 150 revolutions.
9. Repeat steps 7 and 8. Data gathered are for after 170 and 190 revolutions.
10. Repeat steps 7 and 8. Data gathered are for after 210 and 230 revolutions. Spin for 20 revolutions more. This marks the after 250 revolutions data.

Data Analysis: Breakdown of the Suds Category

| | | |
|---|---|---|
| Suds generation | 10-70 revolutions data | Washing Cycle |
| Suds stability | 90-110 revolutions data | |
| Suds elimination | 130-250 revolutions data | Rinsing Cycle: Rinse data analysis is focused on Rinse (1:8) which corresponds to 210-250 revolutions. |

Test 4: Performance Evaluation (Hand-Washing)

Standard Washing Procedure

1. Fill a basin with 2 L DI water (4 gpg) and dissolve the laundry detergents to reach a concentration of 3,500 ppm in the water and swirl for 2 min until it fully dissolves and forms a laundry liquor.
2. Put a piece of fabric into the laundry liquor and soak for 5 min.
3. For each piece of fabric, scrub it 5 times, dip back into the laundry liquor between each scrub.
4. Wring the scrubbed fabric gently, not disturbing the suds produced.
5. Take a photo of the suds generated on laundry liquor water surface during the wash step.
6. Take five measurements of the total height of the suds and laundry liquor, including one center point and four edge points of the basin. Calculate the average from the five measurements to determine the overall total height of the suds and laundry liquor.
7. Measure the laundry liquor height in the basin by removing suds from the basin.
8. Calculate the suds height by substracting the measurement in step 7) from step 6).

Standard Rinsing Process

9. Put the washed and wringed piece of fabric into a new basin comprising 2 L of fresh DI water (4 gpg) by controlling the laundry liquor carryover to be 200+5 g (carryover=total weight after wash−dry fabric weight). Rinse each piece of fabric with 3 gentle scrubs.
10. Take a photo of the suds coverage on the rinse solution water surface within 5-10 sec after removing the piece of fabric from the water.

As a summary, the conditions set for the washing and rinsing process are provided in below table.

| | | | |
|---|---|---|---|
| Product concentration | 3500 ppm | Soaking time: | 5 min |
| Water volume: | 2 L Deionized water | Washing scrubs: | 5 scrubs |
| Water hardness | 4 gpg | $1^{st}/2^{nd}$ rinse time: | 3 scrubs |
| Water temp. | 20-25° C. | Rinse method: | Hand washing |
| Grading method | Ruler to measure suds height when coverage area = 100% or picture for coverage percentage when coverage <100% | | |
| Fabric: | 1 piece of terry towel (20 cm × 20 cm), 2 pieces of knitted cotton (40 cm × 40 cm). Total dry weight = 115 + 3 g | | |

Test 5: Consumer Test

Consumer testing are conducted using a 30-base person panel to do a hand wash process using: (i) a control, and (ii) a prototype detergent with the foam control composition (0.6 wt %). Individuals use their own clothing for the consumer test. After washing with one product, the consumer is asked to provide feedback on the product's perceived attributes (i.e., rinsing attributes). Once the consumer has tested both products, the next step is for the consumer to indicate their preference in key attributes and in overall product acceptance.

EXAMPLES

Example 1

Making Various Laundry Detergent Composition

The foam control compositions are added to commercially available Tide® laundry detergent powder as available for purchase in grocery stores in India or Ariel® laundry detergent powder as available for sale in Mexico.

| Formulation | Code |
|---|---|
| Tide ® India + Foam Control Composition* (0.5 wt %) | Tide ®-IN (0.5 wt %) |
| Tide ® India + Foam Control Composition* (1.0 wt %) | Tide ®-IN (1.0 wt %) |
| Tide ® India Control | Tide ® IN-Control |
| Ariel ® Mexico + Foam Control Composition* (0.61 wt %) | Ariel ®-MX (1.0 wt %) |
| Ariel ® Mexico + Foam Control Composition* (0.3 wt %) | Ariel ®-MX (0.5 wt %) |
| Ariel ® Mexico Control | Ariel ® MX-Control |

*The antifoam was made as described above.

Example 2

Sudsing Profile Test Result

The laundry detergent formulations encompassed by Example 1 are tested for suds generation and suds rinse according to the protocol as described in the Test Methods. The surfactant concentration is about 3,500 ppm. The results are shown in Table 4 below.

Wash Suds Index (WSI) is used to compare the suds volume generated during the washing stage by the present laundry detergent comprising a granulated foam control composition versus a laundry detergent alone without the present granulated foam control composition as a control. Herein, the suds volume is measured by the suds height following a standardized washing process described above.

Rinse Suds Index (RSI) is used to compare the suds volume remaining after rinsing of the present laundry detergents comprising granulated foam control composition versus the laundry detergents alone as a control. Herein the suds volume is measured by the surface area of suds in a rinsing basin following a standardized rinsing process described above.

TABLE 3

| Wash Suds Index and Rinse Suds Index Result | | | | | | | |
|---|---|---|---|---|---|---|---|
| | Ex. 1 Control | Ex. 2 Tide ® IN | Ex. 3 Tide ® IN | Ex. 4 Tide ® IN | Ex. 5 Tide ® IN | Ex. 6 Tide ® IN | Ex. 7 Tide ® IN |
| Foam Control Comp. | — | P7 | P14 | P15 | P16 | P4 | P2-a |
| Amt. of FCC | 0 wt % | | | 0.5 wt % | | | |
| Wash Suds Index | 100% | 101.1% | 95% | 100% | 98.6% | 102% | 98.8% |
| Rinse Suds Index | 100% | 18.8% | 15.5% | 16% | 10% | 16% | 20.5% |

As can be seen from Table 3, detergent compositions comprising a foam control composition according to the present invention exhibited excellent wash suds index comparable to that of control detergent compositions without the foam control composition. However, detergent compositions comprising a foam control composition according to the present invention exhibited significantly reduced rinse suds, as compared to compositions outside of the present invention, after just one rinse.

Example 3

Hand-Washing Result

Figure 4:
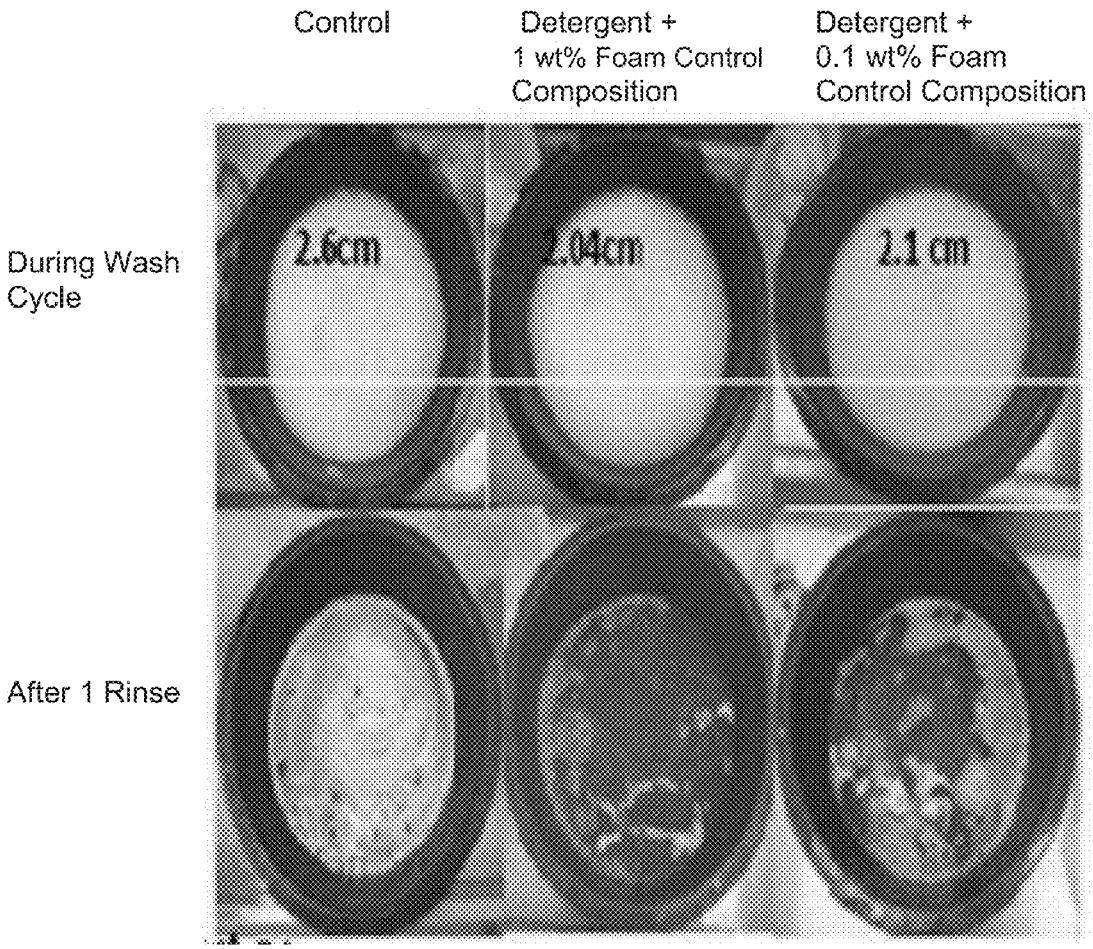
FIG. 4 provides photos of the results from the Hand-Washing Test from Example 3.

Polymer P16 demonstrated the most dramatic suds reduction from the results in Example 2, and it was then tested in full-scale hand-washing assay. For each leg, photos are taken during the wash step and after the 1$^{st}$ rinse. The 3 legs tested include a control (Ariel®-MX) and two detergent compositions comprising the foam control composition at 1 wt % (Ariel®-MX (1.0 wt %)) or 0.1 wt % (Ariel®-MX (0.1 wt %)). FIG. 4 provides photos of the 3 legs. The photos show that detergent compositions comprising the foam control composition performed better than conventional detergent composition (i.e., the control). It is obvious that with one rinse, the preferred detergent composition has removed suds from at least 95% and even possibly 99% of a surface area of the laundry liquor. Therefore, FIG. 4 depicts suds coverage of the wash and rinse solution water surfaces. These photos can serve as reference for what 100% suds coverage and 95%-99% suds free water surfaces may look like. Another way to characterize the suds level is that the laundry liquor treated with the preferred detergent composition is clearly an example of a laundry liquor that is substantially free of suds. Alternatively, the suds level can be determined according to the Suds Coverage Test as described in PCT Publication No. WO2009/112974.

Example 4

Consumer Test Result

Table 4 describes the comparative data between the prototype laundry detergent with the foam control composition and the reference detergent powder in a consumer test. The data in Table 4 indicates that the formulation with the foam control composition showed higher cleaning performance, higher soapiness during wash, comparatively higher amount of suds overall, high speed of lathering, comparatively lower lather at rinse step, comparatively superior hand mildness, and comparatively higher transparency of rinse liquor after 1 rinse. Accordingly, the consumers found that the preferred composition with the foam control composition had longer lasting suds but yet was easier to rinse.

TABLE 4

| Consumer Preference Result | | | |
|---|---|---|---|
| Attribute | Prototype + Foam Control Composition | Reference | No Preference |
| Overall Cleaning | 57% | 30% | 13% |
| Overall Whiteness | 53% | 40% | 7% |
| Soapiness during wash | 70% | 27% | 3% |
| Overall suds | 73% | 23% | 3% |
| Suds consistency | 70% | 27% | 3% |
| Easy to generate suds after dissolving | 70% | 27% | 3% |
| Suds at wash | 67% | 30% | 3% |
| Right amount of suds at wash | 57% | 40% | 3% |
| Suds last longer | 67% | 30% | 7% |
| Easy to rinse | 60% | 33% | 7% |
| Clean water after first rinse | 60% | 40% | 0% |
| Mildness on Hands after rinse | 63% | 27% | 10% |
| No stickiness feeling after rinse | 60% | 30% | 10% |

Example 5

Heavy Duty Powder Detergents

The following heaving duty powder detergents are prepared by mixing the ingredients listed below via conventional processes. Such heavy duty liquid detergents are used to launder fabrics that are then dried by line drying and/or machine drying. Such fabrics may be treated with a fabric enhancer prior to and/or during drying. Such fabrics exhibit a clean appearance and have a soft feel.

TABLE 5

| Powder Detergent Compositions | | | |
|---|---|---|---|
| Ingredient | Ex. 1 wt % | Ex. 2 wt % | Ex. 3 wt % |
| LAS (Non-sulphated anionic surfactant) | 10.0 | 15.0-16.0 | 7.0 |
| Mixture of alkyl sulphate surfactants | 1.5 | 1.5-2 | 1.5 |
| Cationic surfactant | 0.0-1.0 | 0.0-1.5 | 0.0-1.0 |
| Non ionic surfactant | 0.0-1.0 | 0.0-1.5 | 0.0-1.0 |
| Zeolite | 0.0-3.0 | 6.0-10.0 | 0.0-3.0 |

TABLE 5-continued

| Powder Detergent Compositions | | | |
|---|---|---|---|
| Ingredient | Ex. 1 wt % | Ex. 2 wt % | Ex. 3 wt % |
| Polymeric dispersing or soil release agents | 1.0-3.0 | 1.0-4.0 | 1.0-3.0 |
| Bleach and bleach activator | 0.0-5.0 | 4.0-6.0 | 2-3.0 |
| Silicate | 7.0-9.0 | — | 5.0-6.0 |
| Carbonate | 10.0-30.0 | 25.0-35.0 | 15.0-30.0 |
| Sulfate | 30.0-70.0 | 30.0-35.0 | 40.0-70.0 |
| Foam control composition of the present invention | 0.0-1.5 | 0.0-1.5 | 0.0-1.5 |
| Deionized water | Balance to 100 wt % | | |

Example 6

Heavy Duty Liquid Detergents

The following heaving duty liquid detergents are made by mixing the ingredients listed below via conventional processes. Such heavy duty liquid detergents are used to launder fabrics that are then dried by line drying and/or machine drying. Such fabrics may be treated with a fabric enhancer prior to and/or during drying. Such fabrics exhibit a clean appearance and have a soft feel.

TABLE 6

| Liquid Detergent Compositions | | | | | | |
|---|---|---|---|---|---|---|
| Ingredient | Ex. 1 | Ex. 2 | Ex. 3 | Ex. 4 | Ex. 5 | Ex. 6 |
| | wt % | | | | | |
| $C_{12-15}$ alkyl polyethoxylate (1.8) sulfate[1] | 16.0 | 16.0 | 14.6 | 8.0 | 20.1 | 7.3 |
| $C_{12}$ alkyl trimethyl ammonium chloride[2] | — | — | — | — | 2.0 | — |

TABLE 6-continued

| Liquid Detergent Compositions | | | | | | |
|---|---|---|---|---|---|---|
| Ingredient | Ex. 1 | Ex. 2 | Ex. 3 | Ex. 4 | Ex. 5 | Ex. 6 |
| | wt % | | | | | |
| $C_{16}/C_{17}$ Sodium Alkylsulfonate (HSAS)[3] | 1.9 | 1.9 | 1.7 | — | — | 0.85 |
| Sodium alkylbenzenesulfonate[3] | 4.5 | 4.9 | 4.4 | 3.5 | — | 2.0 |
| 1,2 Propane diol/di-ethylene glycol | 4.7 | 4.8 | 4.4 | 2.6 | 4.9 | 2.7 |
| Ethanol | 1.9 | 1.9 | 1.9 | 1.1 | 2.7 | 0.9 |
| Neodol 23-9[9] | 0.7 | 0.7 | 0.7 | 0.3 | 0.8 | 0.4 |
| $C_{12-18}$ Fatty Acid[4] | 1.6 | 1.6 | 1.4 | 0.5 | 1.0 | 0.7 |
| Citric acid | 3.6 | 3.6 | 3.3 | 1.5 | 3.4 | 1.6 |
| Enzymes, (Protease[5], amylase[5]) | 1.8 | 1.8 | 1.6 | 0.6 | 0.35 | 0.8 |
| Fluorescent Whitening Agent[6] | 0.21 | 0.19 | 0.19 | 0.07 | 0.08 | 0.13 |
| DTPA | 0.35 | 0.32 | 0.32 | 0.4 | 0.5 | 0.2 |
| Ethoxylated polyamine[7] | 2.5 | 1.6 | 1.6 | 1.5 | 0.6 | 0.75 |
| Hydrogenated castor oil | — | 0.12 | 0.12 | 0.6 | 0.12 | 0.1 |
| Ethoxylated hexamethylane diamine[8] | 1.5 | — | — | — | — | — |
| Foam control comp. of the present invention | 1.56 | 2.6 | 5.25 | 5.25 | 4.2 | 5.25 |
| Water and adjuncts[11] | Balance to 100 wt % | | | | | |

[1]Available from Shell Chemicals, Houston, TX.
[2]Available from Degussa Corporation, Hopewell, VA.
[3]Available from Shell Chemicals, Houston, TX.
[4]Available from The Procter & Gamble Company, Cincinnati, OH.
[5]Available from Genencor International, South San Francisco, CA.
[6]Available from Ciba Specialty Chemicals, High Point, NC.
[7]Sold under the tradename LUTENSIT ®, available from BASF (Ludwigshafen, Germany) and described in PCT Publication No. WO2001/05874.
[8]Available from Nippon Shokkabai.
[9]Aminofunctional silicones,; KF869, KF867 Shin-Etsu Silicones, Akron OH; CF42-xxx from Momentive Silicones, Akron, OH, USA; a polydimethyl siloxane of viscosity 5000, 10000 Cst available from Gilest, Morrisville, PA, USA and 60,000 centistroke available from Dow Corning Corporation, Midland, MI.
[10]TDA silicone pendent cationic acrylamide, silicone modified polyethyleneimine, supplied by BASF, 67056 Ludwigshafen, Germany.
[11]May include, but not limited to: stabilizers, perfumes, dyes, rheology modifiers, opacifier, cleaning polymers, and optional components.

TABLE 7

| Liquid Detergent Compositions | | | | | | |
|---|---|---|---|---|---|---|
| Ingredient | Ex. 7 | Ex. 8 | Ex. 9 | Ex. 10 | Ex. 11 | Ex. 12** |
| | wt % | | | | | |
| Alkyl ether sulfate (EO 1.8) | 16.6 | 8.2 | 16.6 | 11.3 | 8.5 | — |
| Alkyl ether sulfate (EO 1.2) | 0.0 | 0.0 | 0.0 | 0.0 | 0.0 | 20.3 |
| Linear Alkylbenzene sulfonate | 4.9 | 8.2 | 4.9 | 1.6 | 1.2 | 18.4 |
| Branched alkyl sulfate | 2.0 | 0.0 | 2.0 | 0.8 | 0.6 | — |
| Amine oxide | 0.7 | 0.0 | 0.7 | 0.3 | 0.3 | — |
| Alkyl ethoxylate (E09) | 0.8 | 0.7 | 0.8 | 0.4 | 0.3 | 4.8 |
| Alkyl ethoxylate (EO7) | 0.0 | 4.6 | 0.0 | 0.0 | 0.0 | — |
| Citric acid | 3.2 | 3.9 | 3.2 | 2.5 | 1.9 | 0.7 |
| Palm kernel fatty acid | 1.7 | 3.2 | 1.7 | 0.0 | 0.0 | 4.8 |
| Protease | 1.3 | 1.1 | 1.3 | 0.5 | 0.2 | 2.9 |
| Amylase[5] | 0.4 | 0.3 | 0.4 | 0.1 | 0.0 | 0.6 |
| Borax | 2.6 | 1.8 | 2.6 | 3.0 | 2.2 | 0.0 |
| Calcium and sodium formate | 0.2 | 0.2 | 0.2 | 0.7 | 1.0 | 0.0 |
| Glycerol | 0.0 | 0.0 | 0.0 | 0.0 | 0.0 | 3.5 |
| Amine ethoxylate polymers | 3.3 | 2.7 | 3.3 | 1.1 | 0.3 | 7.7 |
| DTPA | 0.3 | 0.2 | 0.3 | 0.6 | 0.5 | 1.2 |
| Fluorescent whitening agent | 0.2 | 0.2 | 0.2 | 0.1 | 0.1 | 0.5 |
| Ethanol | 2.3 | 1.2 | 2.3 | 1.6 | 1.2 | 0.0 |
| PEG | 0.1 | 0.1 | 0.0 | 0.0 | 0.0 | 0.0 |
| Propylene glycol | 4.0 | 2.4 | 4.0 | 2.9 | 2.1 | 14.0 |

TABLE 7-continued

| Liquid Detergent Compositions | | | | | | |
|---|---|---|---|---|---|---|
| Ingredient | Ex. 7 | Ex. 8 | Ex. 9 | Ex. 10 | Ex. 11 | Ex. 12** |
| | wt % | | | | | |
| Diethylene glycol | 1.2 | 3.0 | 1.2 | 2.3 | 1.1 | 0.0 |
| Ethanolamine | 2.3 | 1.2 | 2.3 | 1.7 | 1.3 | 7.8 |
| NaOH | 2.9 | 2.1 | 2.9 | 1.6 | 1.2 | 0.2 |
| NaCS | 0.0 | 0.0 | 0.0 | 0.0 | 0.0 | 0.0 |
| Structurant[1] | 0.0 | 0.0 | 0.0 | 0.2 | 0.2 | 0.1 |
| Dye | 0.01 | 0.01 | 0.01 | 0.01 | 0.01 | 0.0 |
| Perfume | 0.6 | 0.7 | 0.6 | 0.5 | 0.5 | 2.4 |
| Foam control comp. of the present invention | 0.5-1.5 | 0.5-1.5 | 0.5-1.5 | 0.5-1.5 | 0.5-1.5 | 0.5-1.5 |
| Opacifier | 0.0 | 0.0 | 0.0 | 0.0 | 0.0 | 1.6 |
| Water and miscellaneous | 48.5 | 50.6 | 48.1 | 66.1 | 75.2 | 8.4 |
| Total | 100 wt % | | | | | |

[1]Hydrogenated castor oil prepared as described in U.S. Pat. No. 6,855,680B2.
[5]Available from Genencor International, South San Francisco, CA.
**Unit dose product from The Procter & Gamble Company, Cincinnati, OH.

Example 7

Fabric Enhancers

Fabric enhancer compositions may be prepared by mixing together the ingredients listed in the proportions shown:

TABLE 8

| Fabric Enhancer Compositions | | | | | |
|---|---|---|---|---|---|
| Ingredient | Ex. 1 | Ex. 2 | Ex. 3 | Ex. 4 | Ex. 5 |
| | wt % | | | | |
| FSA[a] | 12.0 | 21.0 | 18.0 | 14.0 | 12.0 |
| FSA[b] | — | — | — | — | — |
| FSA[c] | — | — | — | — | — |
| Low Mw alcohol | 1.95 | 3.0 | 3.0 | 2.28 | 2.28 |
| Rheology modifier[d,e,] | 1.25[d] | — | 0.2[e] | — | 0.2[e] |
| Perfume | 1.50 | 2.3 | 2.0 | 1.50 | 1.50 |
| Perfume encapsulation | 0.6 | 0.3 | 0.4 | — | 0.15 |
| Phase Stabilizing Polymer[f] | 0.25 | — | — | 0.142 | 0.25 |
| Suds Suppressor[g] | — | — | — | — | — |

TABLE 8-continued

| Fabric Enhancer Compositions | | | | | |
|---|---|---|---|---|---|
| Ingredient | Ex. 1 | Ex. 2 | Ex. 3 | Ex. 4 | Ex. 5 |
| | wt % | | | | |
| Calcium Chloride | 0.10 | 0.12 | 0.1 | 0.45 | 0.55 |
| DTPA[h] | 0.005 | 0.005 | 0.005 | 0.005 | 0.005 |
| Preservative (ppm)[i] | 5 ppm | | | | |
| Antifoam[j] | 0.015 | 0.15 | 0.11 | 0.011 | 0.011 |
| Polyethylene imines[l] | 0.15 | 0.05 | — | 0.1 | — |
| Foam control comp. of the present invention | 1.56 | 2.6 | 5.25 | 5.25 | 4.2 |
| Stabilizing Surfactant[o] | — | — | 0.5 | 0.2 | 0.2 |
| Organosiloxane polymer[p] | 5 | — | — | — | — |
| Amino-functional silicone | — | — | — | — | 5 |
| Dye (ppm) | 40 | 11 | 30 | 40 | 40 |
| Ammonium Chloride | 0.10 | 0.12 | 0.12 | 0.10 | 0.10 |
| HCl | 0.010 | 0.01 | 0.10 | 0.010 | 0.010 |
| Deionized Water | Balance to 100 wt % | | | | |

TABLE 9

| Fabric Enhancer Compositions | | | | | | | |
|---|---|---|---|---|---|---|---|
| Ingredient | Ex. 6 | Ex. 7 | Ex. 8 | Ex. 9 | Ex. 10 | Ex. 11 | Ex. 12 |
| | wt % | | | | | | |
| FSA[a] | 16 | 12 | 5 | 5 | — | — | — |
| FSA[b] | — | — | — | — | 3.0 | — | — |
| FSA[c] | — | — | — | — | — | 7.0 | — |
| FSA[z] | — | — | — | — | — | — | 12.0 |
| Low MW alcohol | 1.50 | 2.68 | 0.81 | 0.81 | 0.3 | 0.9 | — |
| Rheology modifier[d,e,] | — | — | 0.42[d] | 0.25[e] | 0.5[d] | 0.70[d] | — |
| Perfume | 2.20 | 1.50 | 0.60 | 0.60 | 1.30 | 0.8-1.5 | 2.4 |
| Perfume encapsulation | 0.4 | 0.25 | — | 0.3 | 0.1 | — | — |
| Phase Stabilizing Polymer[f] | — | 0.25 | — | — | — | — | — |
| Suds Suppressor[g] | — | — | 0.1 | — | — | 0.1 | — |
| Calcium Chloride | 0.350 | 0.545 | — | — | — | 0.1-0.15 | 0.05 |
| DTPA[h] | 0.005 | 0.007 | 0.002 | 0.002 | 0.20 | — | 0.05 |
| Preservative (ppm)[i] | 5 ppm | | | | — | 250 ppm | 75 ppm |
| Antifoam[j] | 0.011 | 0.011 | 0.015 | 0.015 | — | — | 0.005 |
| Polyethylene imines[l] | — | 0.1 | — | 0.05 | — | — | — |
| Foam control comp. of the present invention | 1.56 | 2.6 | 5.25 | 5.25 | 4.2 | 4.2 | 1.56 |
| PDMS emulsion[n] | — | — | 0.25 | — | — | — | — |
| Stabilizing Surfactant[o] | 0.1 | 0.2 | — | — | — | — | — |
| Organosiloxane polymer[p] | 2.0 | — | — | — | — | 0-5.0 | 3.0 |

TABLE 9-continued

| Fabric Enhancer Compositions | | | | | | | |
|---|---|---|---|---|---|---|---|
| Ingredient | Ex. 6 | Ex. 7 | Ex. 8 | Ex. 9 | Ex. 10 | Ex. 11 | Ex. 12 |
| | wt % | | | | | | |
| Amino-functional silicone | — | 2 | — | — | — | 0-5.0 | — |
| Dye (ppm) | 40.0 | 40.0 | 30.0 | 30.0 | 11.0 | 30-300 | 30-300 |
| Ammonium Chloride | 0.10 | 0.115 | — | — | — | — | — |
| HCl | 0.010 | 0.010 | 0.011 | 0.011 | 0.016 | 0.025 | 0.01 |
| Deionized Water | Balance to 100 wt % | | | | | | |

[a]N,N-di(tallowoyloxyethyl)-N,N-dimethylammonium chloride.

[b]Methyl bis (tallow amidoethyl)2-hydroxyethyl ammonium methyl sulfate.

[c]Reaction product of Fatty acid with Methyldiethanolamine in a molar ratio 1.5:1, quaternized with Methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[z]The Reaction product of fatty acid with an iodine value of 40 with methyl/diisopropylamine in a molar ratio from about 1.86 to 2.1 fatty acid to amine and quaternized with methyl sulfate.

[d]Cationic high amylose maize starch available from National Starch under the trade name HYLON VII ®.

[e]Cationic polymer available from Ciba under the name Rheovis CDE.

[f]Copolymer of ethylene oxide and terephthalate having the formula described in U.S. Pat. No. 5,574,179 at col.15, lines 1-5, wherein each X is methyl, each n is 40, u is 4, each $R^1$ is essentially 1,4-phenylene moieties, each $R^2$ is essentially ethylene, 1,2-propylene moieties, or mixtures thereof.

[g]SE39 from Wacker.

[h]Diethylenetriaminepentaacetic acid.

[i]Koralone B-119 available from Rohm and Haas Co. "PPM" is "parts per million".

[j]Silicone antifoam agent available from Dow Corning Corp. under the trade name DC2310 ®.

[l]Polyethylene imines available from BASF under the trade name Lupasol ®.

[m]TDA silicone pendent cationic acrylamide, silicone modified polyethyleneimine, supplied by BASF, 67056 Ludwigshafen, Germany.

[p]Organosiloxane polymer condensate made by reacting hexamethylenediisocyanate (HDI), and a,w silicone diol and 1,3-propanediamine, N'-(3-(dimethylamino)propyl)-N,N-dimethyl-Jeffcat Z130) or N-(3-dimethylaminopropyl)-N,Ndi-isopropanolamine (Jeffcat ZR50) commercially available from Wacker Silicones, Munich, Germany.

Example 8

Rinse Additive

Rinse additive compositions may be prepared by mixing together the ingredients listed in the proportions shown:

TABLE 10

| Rinse Additive Compositions | |
|---|---|
| Ingredient | % wt |
| Structure material | 0-1.0 |
| Foam control composition of the present invention | 0-0.5 |
| Dye | 0-0.01 |
| Perfume | 0-1.0 |
| Preservative | 0-0.2 |
| Deionized Water | Balance to 100 wt % |

Example 9

Liquid Dish Hand-Washing Detergents

Liquid dish detergent compositions may be prepared by mixing together the ingredients listed in the proportions shown:

TABLE 11

| Liquid Dish Detergent Compositions | | | | |
|---|---|---|---|---|
| Ingredient | Ex. 1 | Ex. 2 | Ex. 3 | Ex. 4 |
| | wt % | | | |
| Alkyl $C_{12-14}$ Ethoxy$_{0.6}$ Sulfate | 18.0 | — | — | — |
| Alkyl $C_{10-14}$ Ethoxy$_{0.5-2.5}$ Sulfate | — | 17.0 | 17 | 18.0 |
| Coco amido propyl Betaine | — | — | 9.0 | 5.0 |
| Alkyl $C_{8-12}$ Ethoxylate$_{5-9}$ Nonionic | — | — | 1.0 | — |
| Dimehtyl coco alkyl Amine Oxide | 6.0 | 5.5 | — | 4.0 |
| Alkylpolyglucoside | — | — | — | 4.0 |

TABLE 11-continued

| Liquid Dish Detergent Compositions | | | | |
|---|---|---|---|---|
| Ingredient | Ex. 1 | Ex. 2 | Ex. 3 | Ex. 4 |
| | wt % | | | |
| Ethanol | — | — | 5 | 7.0 |
| Polypropyleneglycol | 0.65 | 0.8 | — | — |
| Citrate | 2.5 | — | — | 0.6 |
| Glutamic acid diacetic acid | — | 0.7 | — | — |
| Methylglycine diacetic acid | — | — | 0.5 | — |
| NaCl | 0.5 | 1.0 | — | 1.5 |
| Sodium cumene sulfonate | — | — | 0.8 | — |
| Glycerol | — | 5.0 | 3.0 | — |
| Na-lactate | — | — | — | 5.0 |
| Guar hydroxypropyl trimmonium chloride N-Hance ® 3270 (Hercules-Aqualon) | 0.1 | 0.1 | 0.3 | 0.2 |
| Protease Purafect Prime ® ex Genencor | — | — | 25 ppm | — |
| Glycol distearate from Euperlan ® Cognis | 0.4 | — | 0.4 | — |
| Hydrogenated Castor Oil Thixcin ® Elementis | — | 0.1 | — | 0.1 |
| [m]Mica-based effect pigment Mearlin ® Superfine (available from BASF) | — | 0.05 | — | 0.05 |
| Petrolatum | — | 0.3 | — | 1.0 |
| Foam control composition of the present invention | 0-1.5 | 0-1.5 | 0-1.5 | 0-1.5 |
| Minors* | Balance to 100 wt % | | | |
| pH | 9 | 9 | 6 | 9 |

TABLE 12

| Liquid Dish Detergent Compositions | | | | |
|---|---|---|---|---|
| Ingredient | Ex. 5 | Ex. 6 | Ex. 7 | Ex. 8 |
| | wt % | | | |
| Linear Alkyl benzene Sulfonate | — | — | 12.0 | 7.0 |
| Alkyl $C_{10-14}$ Ethoxy$_{0.5-2.5}$ Sulfate | 9.0 | 25.0 | 11.0 | — |
| Paraffin Sulfonate | 20.0 | — | — | — |
| Coco amido propyl Betaine | 4.0 | 1.5 | — | — |
| Alkyl $C_{8-12}$ Ethoxylate$_{5-9}$ Nonionic | 6.0 | 0.4 | 0.6 | 2 |
| Dimehtyl coco alkyl Amine Oxide | — | — | 5.0 | 0.5 |
| Alkylpolyglucoside | — | — | — | 4.0 |
| Ethanol | 3.0 | — | 4.0 | — |

TABLE 12-continued

| Liquid Dish Detergent Compositions | | | | |
|---|---|---|---|---|
| Ingredient | Ex. 5 | Ex. 6 | Ex. 7 | Ex. 8 |
| | wt % | | | |
| Polypropyleneglycol | — | — | — | 0.5 |
| Citrate | 0.1 | 0.5 | 0.3 | 0.8 |
| NaCl | 0.3 | 0.6 | 0.2 | — |
| Sodium cumene sulfonate | — | — | 2.0 | — |
| Sorbitol | — | 8.0 | 6.0 | — |
| Urea | 5.0 | — | — | 3.0 |
| Cationically modified hydroxyethyl cellulose (Polyquaternium-10-UCARE JR-30M ex Amerchol). | 0.05 | 0.15 | 0.2 | 0.25 |
| Protease Purafect Prime ®ex Genencor | 25 ppm | — | 65 ppm | 100 ppm |
| Glycol distearate from Euperlan ® Cognis | 0.5 | — | 0.3 | — |
| Hydrogenated Castor Oil Thixcin ® Elementis | — | 0.15 | — | 0.2 |
| ‴Mica-based effect pigment Mearlin ® Superfine (available from BASF) | — | 0.1 | — | 0.05 |
| Foam control composition of the present invention | 0-1.5 | 0-1.5 | 0-1.5 | 0-1.5 |
| Minors* | Balance to 100 wt % | | | |
| pH | 7 | 5.5 | 7 | 6 |

TABLE 13

| Liquid Dish Detergent Compositions | | | | |
|---|---|---|---|---|
| Ingredient | Ex. 9 | Ex. 10 | Ex. 11 | Ex. 12 |
| | wt % | | | |
| Linear Alkylbenzene Sulfonate | 13.0 | — | — | — |
| Alkyl $C_{10-14}$ $Ethoxy_{0.5-2.5}$ Sulfate | 5.0 | 7.0 | 17.0 | 4.0 |
| Paraffin Sulfonate | — | 15.0 | 3.0 | 10.0 |
| Coco amido propyl Betaine | — | 1.0 | 5.0 | 1.0 |
| Alkyl $C_{8-12}$ $Ethoxylate_{5-9}$ Nonionic | 1.5 | — | 1.0 | 0.5 |
| Dimehtyl coco alkyl Amine Oxide | 0.5 | 2.0 | 2.0 | 1.5 |
| Alkylpolyglucoside | — | 3.0 | — | — |
| Ethanol | 3.0 | — | 2.0 | 3.0 |
| Polypropyleneglycol | 0.5 | — | 1.0 | — |
| Citrate | 0.6 | 0.5 | 1.5 | — |
| NaCl | 0.5 | 0.5 | — | 1.0 |
| Sodium cumene sulfonate | — | — | — | — |
| Glycerol | 5.0 | 3.0 | 4.0 | 7.0 |
| Sorbitol | — | 1.0 | 3.0 | — |
| Guar hydroxypropyl trimmonium chloride N-Hance ® 3215 (Hercules-Aqualon) | 0.1 | 0.15 | 0.2 | 0.05 |
| Protease Purafect Prime ®ex Genencor | 50 ppm | — | — | 90 ppm |
| Glycol distearate from Euperlan ® (available from Cognis) | 0.6 | — | — | — |
| [I]Hydrogenated Castor Oil Thixcin ® (available from Elementis) | — | 0.05 | — | 0.25 |
| ‴Mica-based effect pigment Mearlin ® Superfine (available from BASF) | — | 0.025 | — | 0.2 |
| Foam control composition of the present invention | 0-1.5 | 0-1.5 | 0-1.5 | 0-1.5 |
| Minors* | Balance to 100 wt % | | | |
| pH | 5 | 8 | 7.5 | 7.7 |

*Minors include, such as for example: dyes, opacifier, perfumes, preservatives, hydrotropes, Mg-ions, diamines, processing aids, and/or stabilizers.
[I]Available from Elementis.
‴Available from BASF.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising a foam control composition, wherein the foam control composition comprises a hydrophobically modified cationic polymer comprising:

(i) a first structural unit that is diallyl dimethyl ammonium chloride (DADMAC);

(ii) a second structural unit that is glycidyl (meth)acrylate (GMA);

(iii) a third structural unit that is a mixture of vinylpyrrolidone (VP) and (meth)acrylamide (AAm); and (iv) a fourth structural unit derived from a reactive siloxane.

2. The laundry detergent composition according to claim 1, wherein the fourth structural unit is an aminosilicone, a silicone aminoalcohol, a silicone polyether, or a mixture thereof.

3. The laundry detergent composition according to claim 2, wherein the fourth structural unit is aminosilicone.

4. The laundry detergent composition according to claim 1, wherein the hydrophobically modified cationic polymer comprises:

(i) from about 5 wt % to about 98 wt % of the first structural unit (ii) from about 1 wt % to about 20 wt % of the second structural unit;

(iii) from about 5 wt % to about 85 wt % of the third structural unit; and (iv) from about 1 wt % to about 20 wt % of the fourth structural unit;

wherein the wt % is based on 100% by weight of all structural units derived from all the monomers and the reactive siloxane present in the hydrophobically modified cationic polymer.

5. The laundry detergent composition according to claim 1, wherein the hydrophobically modified cationic polymer has a weight average molecular weight (Mw) of from about 90,000g/mol to about 700,000g/mol.

6. The laundry detergent composition according to claim 1, wherein the composition comprises from about 0.1 wt % to about 50 wt %, based on the total weight of the composition, of a surfactant selected from the group consisting of an anionic surfactant, an amphoteric surfactant and a mixture thereof.

7. The laundry detergent composition according to claim 6, wherein the surfactant is an anionic detersive surfactant selected from the group consisting of alkyl benzene sulphonic acid or salt thereof, alkyl ethoxylated sulphate, and a mixture thereof.

8. The laundry detergent composition according to claim 1, wherein the laundry detergent composition has a Rinsing Suds Index of less than about 25% as determined by the Sudsing Profile Test as described herein.

9. The laundry detergent composition according to claim 1, wherein the hydrophobically modified cationic polymer is substantially free of carrier particles or coating.

10. A method of improving rinse clarity of a laundry liquor comprising laundering fabrics with a laundry detergent composition according to claim 1.

11. A method of providing positive effect on skin comprising hand-washing fabrics with a laundry detergent composition according to claim 1, wherein the positive effect on skin is improved hand mildness, improved hand softness, or improved hand feel.

12. A method of improving fabric feel comprising laundering fabrics with a laundry detergent composition according to claim 1, wherein the improved fabric feel is improved fabric softness, or improved fabric smoothness.

13. A method of cleaning fabrics comprising the steps of:

(i) providing a laundry detergent composition according to claim 1;

(ii) forming a laundry liquor by diluting the laundry detergent composition with water;

(iii) washing fabrics in the laundry liquor; and (iv) rinsing the fabrics in water; wherein after 2 or less rinses:

a) the laundry liquor is substantially free of suds; or b) at least 75% of a wash surface area of the laundry liquor is free from suds.

14. A method of saving water during laundering comprising the steps of:

(i) providing a laundry detergent composition according to claim 1;

(ii) diluting the laundry detergent composition with wash water to form a laundry liquor;

(iii) washing laundry in the laundry liquor; and (iv) rinsing the laundry; wherein after 2 or less rinses a wash surface area of the laundry liquor is substantially free of suds.

* * * * *